US009199125B2

(12) United States Patent
James et al.

(10) Patent No.: US 9,199,125 B2
(45) Date of Patent: Dec. 1, 2015

(54) SWIM TRAINING APPARATUS

(75) Inventors: Samuel James, Chapel Hill (AU); Mark Dockrill, Chadstone (AU); Kon Euan Gerard Wong, Burwood East (AU); Simon Lawry, Annerley (AU)

(73) Assignee: QUEENSLAND UNIVERSITY OF TECHNOLOGY, Brisbane (AU)

( * ) Notice: Subject to any disclaimer, the term of this patent is extended or adjusted under 35 U.S.C. 154(b) by 70 days.

(21) Appl. No.: 13/983,953

(22) PCT Filed: Aug. 31, 2011

(86) PCT No.: PCT/AU2011/001125

§ 371 (c)(1),
(2), (4) Date: Sep. 26, 2013

(87) PCT Pub. No.: WO2012/122582

PCT Pub. Date: Sep. 20, 2012

(65) Prior Publication Data

US 2014/0018211 A1 Jan. 16, 2014

Related U.S. Application Data

(60) Provisional application No. 61/453,206, filed on Mar. 16, 2011.

(51) Int. Cl.

| | |
|---|---|
| ***A63B 31/00*** | (2006.01) |
| ***A63B 69/00*** | (2006.01) |
| ***A63B 69/12*** | (2006.01) |

(52) U.S. Cl.

CPC ..... *A63B 31/00* (2013.01); *A63B 69/0059* (2013.01); *A63B 69/12* (2013.01); *A63B 2208/03* (2013.01); *A63B 2225/60* (2013.01); *A63B 2244/20* (2013.01)

(58) Field of Classification Search

CPC ..... A63B 1/00; A63B 1/08; A63B 1/10; A63B 1/11; A63B 1/12; A63B 1/14; A63B 69/0059; A63B 69/12; A63B 2208/03; A63B 2225/60; A63B 2244/20

See application file for complete search history.

(56) References Cited

U.S. PATENT DOCUMENTS

| | | | | |
|---|---|---|---|---|
| 5,002,268 | A | 3/1991 | Anderson | |
| 5,011,137 | A | 4/1991 | Murphy | |
| 5,472,391 | A * | 12/1995 | Weissbuch | 482/55 |
| 6,083,067 | A * | 7/2000 | McCredie | 441/129 |
| 2009/0270001 | A1 * | 10/2009 | Crispin | 441/74 |

OTHER PUBLICATIONS

Samuel James, Exhibitions Photos from Design Institute of Australia showcase at State Library of Queensland (Dec. 2010).
Samuel James, Concept Presentation (Sep. 1, 2010).
Samuel James, Exhibition Display from Design Institute of Australia showcase at State Library of Queensland (Dec. 2010).
Samuel James, Final Design Presentation (Sep. 24, 2010).

(Continued)

*Primary Examiner* — Oren Ginsberg
(74) *Attorney, Agent, or Firm* — Morris, Manning & Martin, LLP; Christopher W. Raimund

(57) ABSTRACT

A swim training apparatus for training a user during swimming, the apparatus including, an at least semi-rigid body, an attachment mechanism to allow the body to be worn by the user so that at least part of the body contacts the user's torso to thereby provide at least one of resistance training for improving at least one of strength and stability of the user, and posture training for guiding user posture.

43 Claims, 20 Drawing Sheets

(56) References Cited

OTHER PUBLICATIONS

Samuel James, Poster 1 from Design Institute of Australia showcase at State Library of Queensland (Dec. 2010).
Samuel James, Poster 2 from Design Institute of Australia showcase at State Library of Queensland (Dec. 2010).
Samuel James, Photograph of Posters from Design Institute of Australia showcase at State Library of Queensland (Dec. 2010).
Samuel James, "Invention powers up elite swimmers", Queensland University of Technology (QUT) News (Dec. 10, 2010).
Samuel James, Research Seminar Presentation (Nov. 10, 2010).

* cited by examiner

Fig. 2A
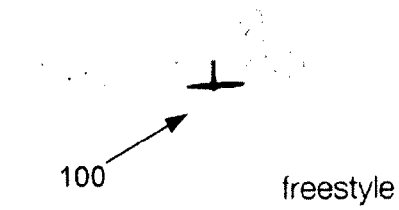
Fig. 2B
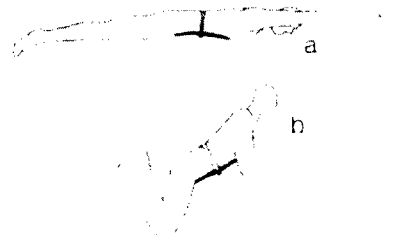
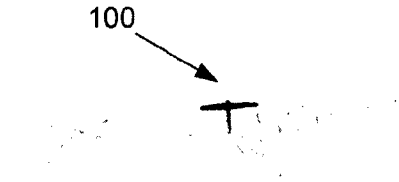
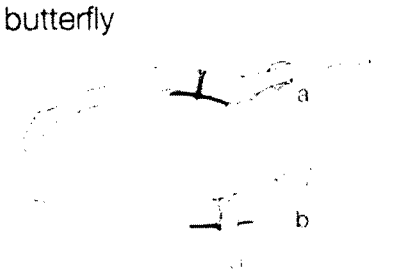
Fig. 2C
Fig. 2D
Fig. 3A
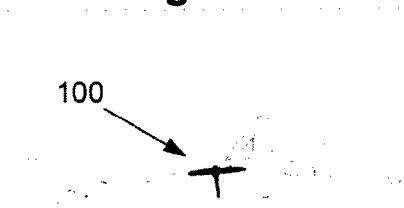
Fig. 3B
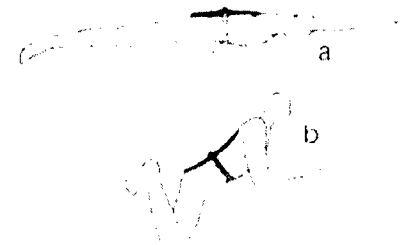
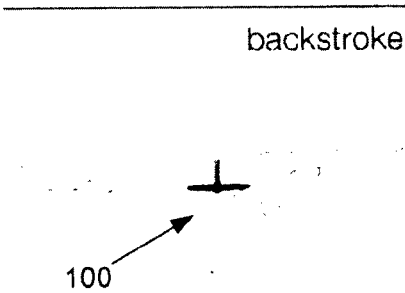
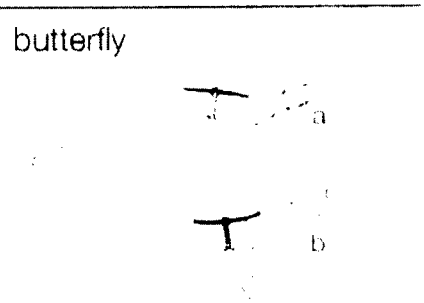
Fig. 3C
Fig. 3D

SWIM TRAINING APPARATUS

BACKGROUND OF THE INVENTION

The present invention relates to a swim training apparatus and method of using a swim training apparatus.

DESCRIPTION OF THE PRIOR ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

The ability to swim efficiently and maintain speed depends on a range of factors, such as the swimmers technique, muscle strength, and the like. Core stability, in general, is important in swimming as in the absence of a solid surface from which to drive, it provides an anchoring effect, through which greater force can be exerted from the extremities. For this reason, core stability can influence other aspects of the stroke, such as the initial catch, the pull, the kick and the glide phases.

In terms of posture, swimmers ideally maintain a straight spine, which alters centre of gravity and creates a more streamlined form. However, to maintain this position requires heightened strength in core muscles such as transversus abdominis, as this position is alien to a normal upright standing posture. When achieved, this change in body shape in turn creates lift (as demonstrated by Newton's laws regarding lift and fluid flow direction), meaning the swimmer's legs sit at a higher angle, making the body as a whole closer to horizontal in the water. This then gives the effect of buoyancy on the swimmer.

Performance-enhancing bodysuits have had a profound performance enhancing effect on the sport of swimming, particularly in recent years. These bodysuits featured plastic coatings such as polyurethane and neoprene, ultrasonically welded seams for drag reduction and inbuilt corsets for compression and stabilisation of the body core. Studies have shown that using bodysuits assists in maintaining posture by providing an elevated body position and flattened spinal position, significantly reducing drag, allowing faster times to be achieved.

Similarly, stabilisation provided by a highly compressive bodysuit may also affect the shape and distribution of the body's mass, whilst compression garments can prevent muscle oscillation, a significant source of both drag and fatigue. In turn, through this compressive effect, it is possible that the swimmer's centre of gravity and centre of buoyancy could be altered. Therefore, a change in centre of buoyancy could alter the angle at which the body sits in the water, known as angle of buoyancy.

In addition to this, when a swimmer achieves an ideal angle of buoyancy in the water, in turn their muscles can achieve a greater mechanical advantage, and become more able to effectively execute catch, pull and recovery of stroke. Similarly, a higher angle allows a larger range of movement in the kick while still minimising active drag, and decreases the distance swimmers must turn their heads to breathe.

With the recent banning of all bodysuits, there has been a corresponding regression in performance. As a result, there is interest in assisting swimmers maintain the body posture and gain additional core strength and stability to counteract the loss of assistance provided by the suits. However, existing techniques for targeting core strength, such as ball and weight exercises are of limited assistance as they do not assist in maintaining posture during swimming.

SUMMARY OF THE PRESENT INVENTION

In a first broad form the present invention provides a swim training apparatus for training a user during swimming, the apparatus including:

a) an at least semi-rigid body;

b) an attachment mechanism to allow the body to be worn by the user so that at least part of the body contacts the user's torso to thereby provide at least one of:

i) resistance training for improving at least one of strength and stability of the user; and, ii) posture training for guiding user posture.

Typically the body is an elongate body.

Typically the body is tapered towards ends of the body.

Typically the body is Y-shaped.

Typically the body extends in a direction substantially parallel to a body plane defined by the body.

Typically the elongate body includes at least one portion that extends at an angle relative to the body plane.

Typically rigidity of the body resists at least one of:

a) bending of the body; and, b) torsional movement of the body.

Typically the elongate body extends along a body plane, and wherein rigidity of the body resists bending of the body at least in a direction orthogonal to the body plane.

Typically the body includes at least two body members having different rigidities.

Typically the rigidity of the body varies along the length of the body.

Typically the rigidity of the body depends on at least one of:

a) a body length;

b) a body thickness;

c) a body width; and, d) a body material.

Typically body ends have a reduced rigidity compared to a body centre portion.

Typically the body includes a body spine coupled to a body member, the body spine providing rigidity to the body member.

Typically the body includes a rigidity adjusting mechanism for selectively adjusting body rigidity.

Typically the body includes a plurality of selectively connectable body members.

Typically the body members are provided in a layered arrangement.

Typically the number of connected body members is selected to thereby adjust at least one of:

a) body rigidity; and, b) body size.

Typically at least one of the body members includes at least one guide for at least one of aligning and connecting the body members.

Typically the guide includes at least one guide aperture provided on at least one body member, the guide aperture being for receiving contact points of at least one adjacent body member.

Typically the guide includes a ridge recess provided on at least one body member, the ridge recess being for receiving a ridge of at least one adjacent body member.

Typically the body members include an aperture, and wherein the apparatus includes a lug coupled to a first body member, the lug being for engaging the aperture of an other body member to thereby secure at least the other body member to the first body member.

Typically the lug is coupled to a knob having a follower, and wherein the knob engages a cam on the first body member to urge the lug against the aperture of the least one other body member to thereby secure the at least one other body member to the first body member.

Typically the body includes:

a) first and second relatively moveable body members; and, b) a resilient member to resist relative movement of the first and second body members.

Typically the first and second body members are connected using a hinge.

Typically the resilient member includes a tensioning chord.

Typically the body includes one or more contact surfaces for contacting the user.

Typically the contact surfaces include gel pads.

Typically the attachment mechanism includes a strap coupled to the body between ends of the body.

Typically the strap is attached to a first one of a plurality of body members.

Typically at least one of a strap and a body member include a waist.

Typically the strap is coupled to the body substantially mid-way along the body.

Typically the strap is worn around a waist of the user in use.

Typically the body is worn in at least one of:

a) a first position in which the body contacts at least part of the abdomen and part of the thorax; and, b) a second position in which the body contacts at least part of the back.

Typically respective apparatus is provided for use in the first and second positions.

Typically the apparatus includes:

a) a first body worn in a first position in which the first body contacts at least part of the abdomen and part of the thorax; and, b) a second body worn in a second position in which the second body contacts at least part of the back.

Typically in a first position the body contacts the user at least:

a) near a sternum of the user; and, b) in a hypogastric region of the user.

Typically in the first position the body contacts at least left and right portions of the hypogastric region of the user to thereby provide resistance to hip rotation of the user.

Typically in a second position the body contacts at least part of a spine of the user.

Typically the body includes a ridge extending along at least part of the body, the ridge being for aligning the body with at least one of a spine and a sternum of the user.

Typically at least one of a body profile, dimension, shape and rigidity is determined for at least one of:

a) providing posture training;

b) providing resistance training;

c) use in a first position;

d) use in a second position; and, e) use for respective swimming strokes.

In a second broad form the present invention provides a method of using a swim training apparatus during swimming, the method including wearing an at least semi-rigid body using a strap coupled to the body to allow the body to be worn by the user so that at least part of the body contacts the user's torso to thereby provide at least one of:

a) resistance training for improving at least one of strength and stability of the user; and, b) posture training for guiding user posture.

Typically the method includes wearing the body in at least one of:

a) a first position in which the body contacts at least part of the abdomen and part of the thorax; and, b) a second position in which the body contacts at least part of the back.

Typically in a first position the body contacts the user at least:

a) near a sternum of the user; and, b) in a hypogastric region of the user.

Typically in the first position the body contacts at least left and right portions of the hypogastric region of the user to thereby provide resistance to hip rotation of the user.

Typically in a second position the body contacts at least part of a spine of the user.

BRIEF DESCRIPTION OF THE DRAWINGS

An example of the present invention will now be described with reference to the accompanying drawings, in which:

FIGS. 2A to 2D show schematic side views of an example of a swim training apparatus in use in a first position during different swimming strokes;

FIGS. 3A to 3D show schematic side views of an example of a swim training apparatus in use in a second position during different swimming strokes;

DETAILED DESCRIPTION OF THE PREFERRED EMBODIMENTS

Figure 1A:
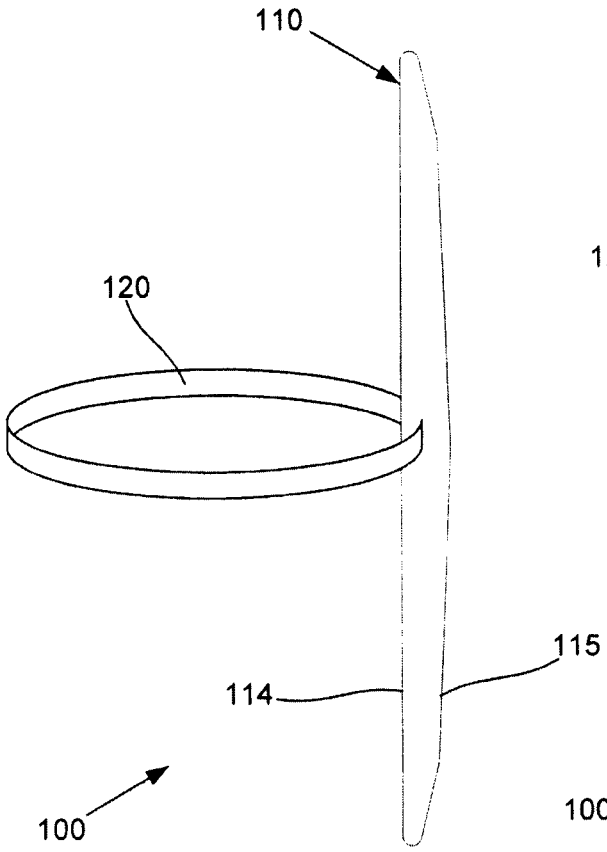
FIGS. 1A and 1B are schematic side and plan views of a first example of a swim training apparatus.
Figure 1B:
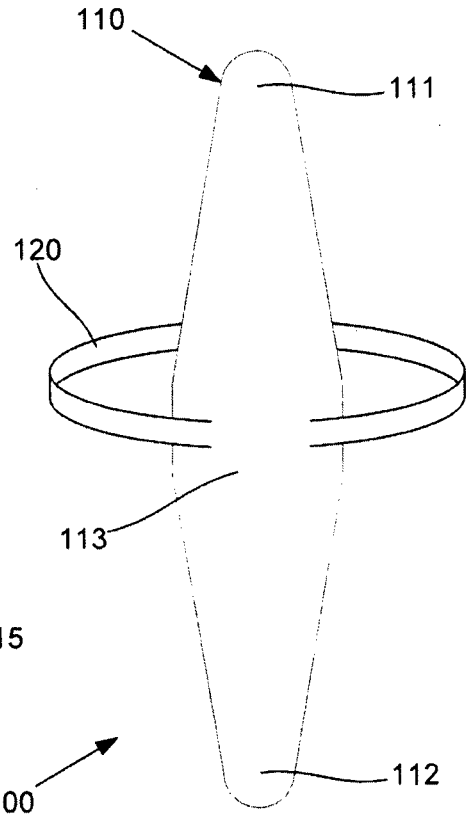
Figure 1C:
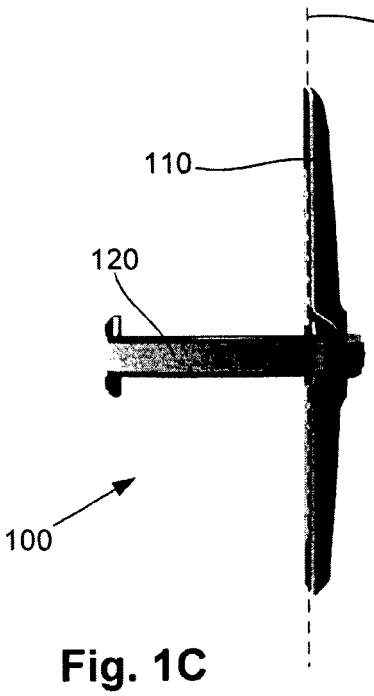
FIGS. 1C and 1D are schematic side views of an example of a swim training apparatus without and with applied forces.
Figure 1D:
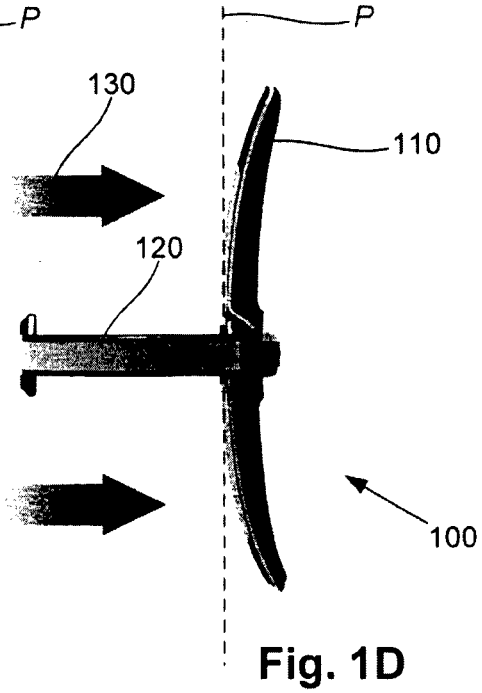
Figure 4A:
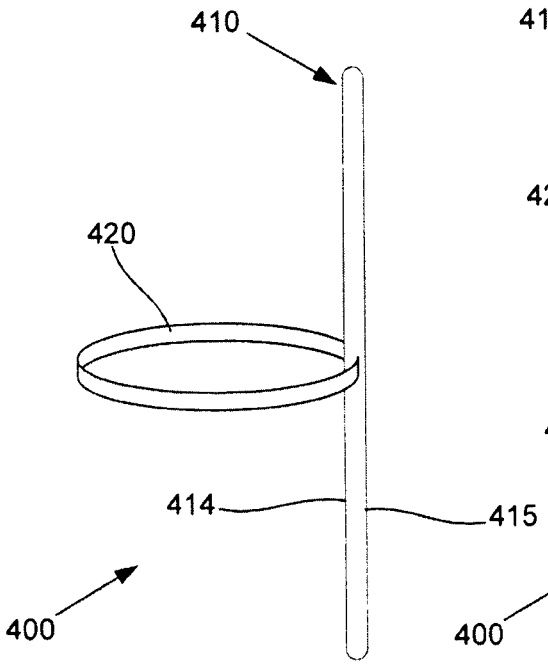
FIGS. 4A to 4D are schematic side, plan, underside and end views of a second example of a swim training apparatus.
Figure 4B:
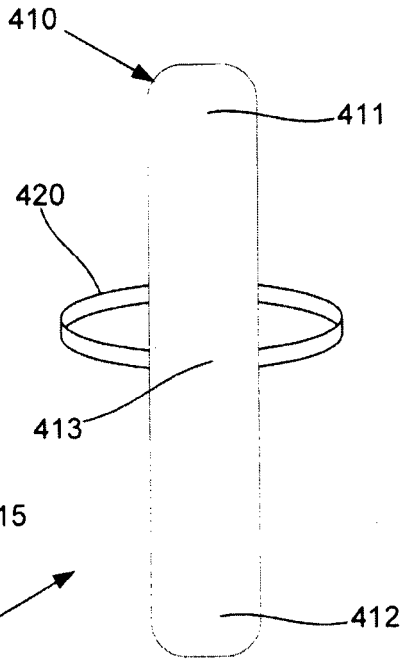
Figure 4C:
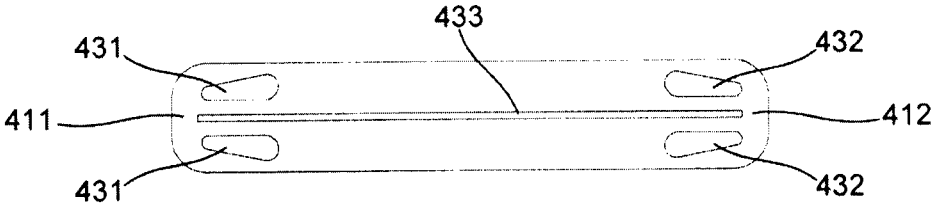
Figure 4D:
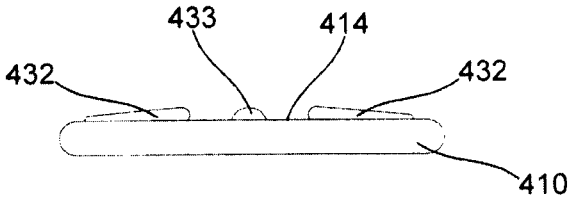

An example of a swim training apparatus will now be described with reference to FIGS. 1A to 1D.

In this example, the swim training apparatus 100 includes a semi-rigid elongate body 110, coupled to an attachment mechanism, such as a strap 120. The attachment mechanism allows the swim training apparatus 100 to be worn by a user so that at least part of the body 110 contacts the user's torso.

In use, the apparatus 110 can be used during swimming either to provide resistance training for strengthening the user or posture training for guiding user posture. In this regard, the body 110 is a semi-rigid body that is designed to oppose forces applied by the user. For example, forces on the body in the direction of arrows 130 urge the body 110 in a direction orthogonal to a body plane P extending through the body 110, with the rigidity of the body 110 providing a restoring force, to thereby guide user posture, and/or provide resistance training, as will be described below.

Whilst different body arrangements can be used, in this example, the body 110 includes tapered ends 111, 112, joined by a central portion 113 having a substantially constant width. The body 110 also includes a first surface 114 that extends substantially parallel to a body plane P, and a second surface 115, which in this example is profiled to taper towards the edges of the body. In use, the apparatus 100 is worn by positioning the strap 120 around the user's waist, with the body 110 positioned so that the first surface 114 is against either the user's front or back, depending on the nature of the training to be performed.

In particular, the apparatus can provide either resistance or posture training, depending on the positioning of the apparatus 100 and the particular stroke currently being performed by the user. In this regard, when performing resistance training, the user will work against the restoring force provided by the body 110, while attempting to maintain a desired swimming posture. This has the effect of strengthening user muscles, thereby enhancing the user's core strength and/or stability. When used for posture training, the user uses contact between their torso and the body 110 to guide their posture, and thereby maintain a preferred swimming posture. The different modes of operation will now be described in further detail.

When the apparatus 100 is attached to a swimmer in a first position, this is achieved by fastening the strap 120 around their waist, with the first surface 114 positioned against the user's front. An example of this use is shown in FIGS. 2A to 2D, which show typical body positions during freestyle, breaststroke, backstroke, and butterfly, respectively. In this example, the user's thorax and abdomen are typically positioned in contact with the first and second ends 111, 112 so that any bending of the user applies a force to the ends 111, 112 of the body 110.

As a result, when swimming in freestyle, and during recovery phases of breaststroke and butterfly strokes (as shown in FIGS. 2B(a) and 2D(a)) the apparatus 100 operates in resistance mode. Consequently, bending of the user is resisted, causing the user to exert additional force, which in turn strengthens the user's muscles. Similarly, the body 110 may also resist torsional rotation, which can in turn resist rotational movement of the user's hips. Accordingly, in this mode of operation, the user's muscles are strengthened, thereby enhancing the user's core strength and stability.

However, when swimming in the remaining stroke positions, namely backstroke, and during propulsive phases of breaststroke and butterfly strokes (as shown in FIGS. 2B(b) and 2D(b)), then the user attempts to keep as much of the first surface 114 in contact with their torso as possible, thereby directing the user to maintain a desired posture, thereby providing posture training. In this case, if the user bends forward, the user feels the resulting restoring force, guiding them to straighten. Similarly, in the event that the user arches their back, the body 110 move away from the user's torso, with the user feeling the absence of contact, again guiding them to straighten their spine. This therefore helps make the swimmer more aware of their body posture, giving them greater proprioception, hence ensuring posture can be maintained even once the apparatus 100 is removed.

When used the apparatus 100 is attached to a swimmer in a second position, this is achieved by fastening the strap 120 around their waist, with the first surface 114 positioned against the user's back, aligned with the spine. An example of this use is shown in FIGS. 3A to 3D, which show typical body positions during freestyle, breaststroke, backstroke, and butterfly, respectively. In this example, the user's back is positioned in contact with the first and second ends 111, 112 so that any bending of the user applies a force to the ends 111, 112 of the body 110.

As a result, when swimming in freestyle, and in the recovery phases of breaststroke and butterfly strokes (as shown in FIGS. 3B(a) and 3D(a)) the apparatus 100 operates in guidance mode, with the user attempting to keep as much of the first surface 114 in contact with their back as possible. This guides the user in maintaining a straight spine, and thereby assists in ensuring correct posture. In the event that the user arches their back, a force is applied to the ends 111, 112 of the body 110, with the user feeling the resulting restoring force, guiding them to straighten their spine. Similarly, in the event that the user bends forward, the ends 111, 112 of the body 110 move away from the user's back, with the user feeling the absence of contact, again guiding them to straighten their spine. This therefore helps make the swimmer more aware of their body posture, giving them greater proprioception, hence ensuring posture can be maintained even once the apparatus 100 is removed. However, when swimming in the remaining stroke positions, namely backstroke, and the propulsive phases of breaststroke and butterfly strokes (as shown in FIGS. 3B(b) and 3D(b)), then bending of the user's back is resisted, thereby providing resistance training.

Thus, it will be appreciated that the above described swim training apparatus 100 can be used in either a first or second mode and can be used to provide either resistance training to thereby enhance the core strength and/or stability of the user, or posture training, to thereby improve the swimming posture of the user. Use in the different modes can easily be achieved depending on how the apparatus 100 is worn and the stroke being performed, allowing a single swim training apparatus 100 to be used to selectively provide resistance and posture training. The combination of these modes of operation promote both awareness and strength in the swimmer, promoting the ability to maintain ideal technique when not using the device.

Thus, by training the user's muscles in this manner, and in particular, by increasing core strength and stability, and by guiding user proprioception, this helps ensure the swimmer swims correctly once the apparatus is removed, thereby leading to an improvement in user times. It will be appreciated that the swim training apparatus 100 can therefore effectively help counteract the increase in swimming times resulting from the banning of body suits, whilst allowing the user to swim unassisted in competition.

A number of further features that can be provided will now be described in more detail.

In the apparatus 100 described above, the width of the body 110 tapers towards the ends 111, 112, whilst the second surface 115 is profiled so that the body 110 is thicker towards a central portion. In this arrangement, the increasing thickness and width can be used to vary the rigidity of the body 110 along the body length, and in particular, reduce the rigidity towards the ends 111, 112. As a result, as force applied to the body 110 increases, greater bending of the body 110 occurs, resulting a greater bending of portions of the body with higher rigidity, thereby increasing the restoring force. As a result, greater applied forces result in a greater restoring force, which in turn gives greater feedback for posture guidance and causes the swimmer to work harder in resistance mode. This, in turn, further increases their core strength, stability and posture, having a greater corrective effect the further away from the ideal posture they are.

Rigidity of the body 110 will also depend on the materials used in construction of the body 110. As the apparatus 100 is required to undergo repeated strain and must be capable of deformation as the user's body rotates and undulates while swimming. In addition the materials used are typically water and chemical resistant to withstand typical swimming environments. Accordingly, in one example, the body 110 is made from polyurethane, plastics, or other similar materials, with the rigidity being selected to meet desired performance characteristics.

Thus, rigidity of the body can depend on factors such as the length of the body, a body thickness, a body width and a body material. It will be appreciated that the rigidity of the body 110 can also be controlled in other ways, as will be described in more detail below.

The dimensions of the body 110 are typically selected to accommodate a large variation in sizes of users. In one example, the body 110 has a length in the region of 30-40 cm, and more typically approximately 35 cm. However, alternatively, different sizes of body 110 can be used for different sizes of user.

The shape of the body may also have an impact on the amount of drag generated by the apparatus. In this regard, the apparatus 100 can be configured to decrease or increase drag in order to decrease or increase the relevance of swimming speed as another form of feedback to the user in terms of core stability/posture while using the apparatus 100. For example, the apparatus can include one or more flaps or pockets positioned thereon to allow the flaps or pockets to capture water and thereby create drag. However, it will be appreciated that drag can be increased through other mechanisms, such as the surface texture of the material used to construct the body 110, as well as through the shape of the body 110, or the like.

In a further example, the drag of the apparatus may be configured to alter depending on the orientation of the body 110, or the force applied to the body 110 by the user. This can be achieved through the use of a adjustable or movable flap, or other suitable mechanism. In this instance, if the user is in a correct posture, during posture training, or is applying a suitable load to the apparatus during resistance training, the drag produced by the apparatus can be reduced so that the user can swim with reduced effort and/or at an increased swimming speed. This additional feedback helps further guide the user to ensure that their posture is correct and/or that they are fully utilising the resistance training provided by the apparatus to increase their core stability or strength.

The buoyancy of the apparatus 100 can also be selected dependent on the preferred use of the apparatus 100. For example, the apparatus 100 can be neutrally buoyant so that the user's gravity and centre of buoyancy remain unaltered when using the apparatus. However, this is not essential, and alternatively, the apparatus 100 could be positively or negatively buoyant. This can be used to alter the swimmer's centre of and overall buoyancy, which can in turn affect the swimmer's angle of buoyancy. This can be used to train the user as to a preferred swimming orientation, as well as using negative buoyancy to increase the drag on the user.

Thus, by altering the drag and/or buoyancy of the apparatus this can further assist swimming training, for example by increasing the workload required by a user to maintain a given speed, and providing further feedback regarding the effectiveness of posture and/or resistance training. This may be achieved at the same time as performing the resistance and/or posture training described above, thereby further enhancing the ability of the apparatus to act as a swim training aid.

The strap 120 must be capable of withstanding tension, allowing the body 110 to be urged against the swimmer, whilst also being chemical and water resistant. Accordingly, the strap 120 may be manufactured using a silicone, fabric or the like. The strap may be connected to the body 110 using any suitable technique, such as inserting the strap 120 through an aperture in the body 110, using connectors, or the like. The strap 120 is also typically adjustable, for example through the use of an adjustable buckle, clip, or plug and slot design, allowing the apparatus to accommodate different sizes of user. However, other configurations of strap can be used, and this is not intended to be limiting. For example, the strap 120 can include a semi-rigid portion, for example as part of a buckle or other connector, which can act to provide further feedback to the user, as will be described in more detail below. Whilst a strap 120 is described as one example of an attachment mechanism, it will be appreciated that other example arrangements, such as arms that extend part way round the user's torso, could also be used.

A second example of a swim training apparatus will now be described with reference to FIGS. 4A to 4D.

In this example, the apparatus 400 includes a body 410 and strap 420. The body 410 is of a substantially uniform cross section along the entire length, so that the ends 411, 412 are the same width and thickness as the central portion 413. In this example, the body 410 can be of a constant rigidity along the body length, or alternatively, variations in rigidity can be provided by use of different materials along the body length, or the use of tensioning or strengthening members, or the like, as will be described in more detail below.

In this example, the body 410 includes a number of contact surfaces 431, 432, 433 mounted on a first surface 414 of the body 410. The contact surfaces 431, 432, 433 are designed to be primary points of contact between the apparatus 400 and the user, and can therefore be used to assist in aligning the body 410 on the user, as well as increasing the feedback provided to the user, whilst making the apparatus 400 comfortable to wear.

The contact surfaces 431, 432 provide guides for positioning the body 410 on the user's front, with the surfaces 431 being provided near the user's sternum, and the surfaces 432 on the user's abdomen in the hypogastric region. The contact surface 433 is a ridge extending along at least part of the length of the body 410, and positioned approximately midway across the width of the body 410. The contact surface 433 is designed to sit in-line with the spine, thereby correctly locating the body 410 on the user's back, and helping prevent the body 410 moving out of position in use.

The contact surfaces can be made of the same material as the body 410, and may therefore be moulded integrally therewith. However, alternatively, the contact surfaces 431, 432 can include gel pads, such as a soft gel material, featuring a puncture-proof skin, making it able to endure rough treatment while in use, storage and transport, whilst providing a comfortable contact point for the user.

Figure 5A:
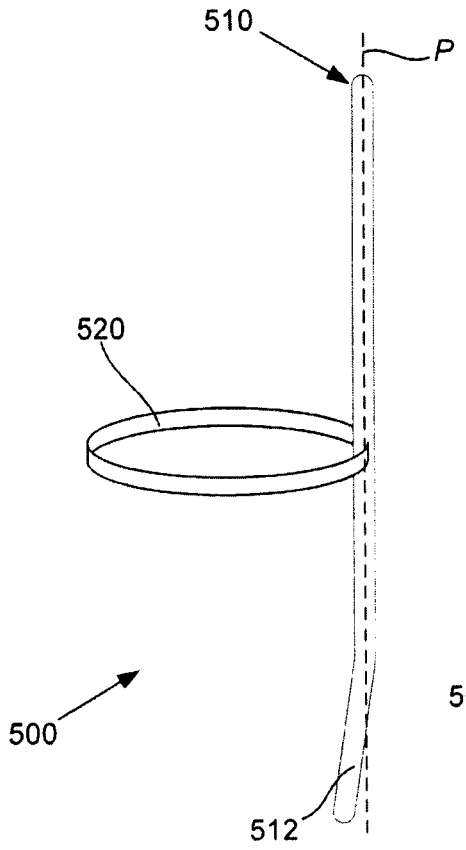
FIGS. 5A to 5C are schematic side, plan and underside views of a third example of a swim training apparatus.
Figure 5B:
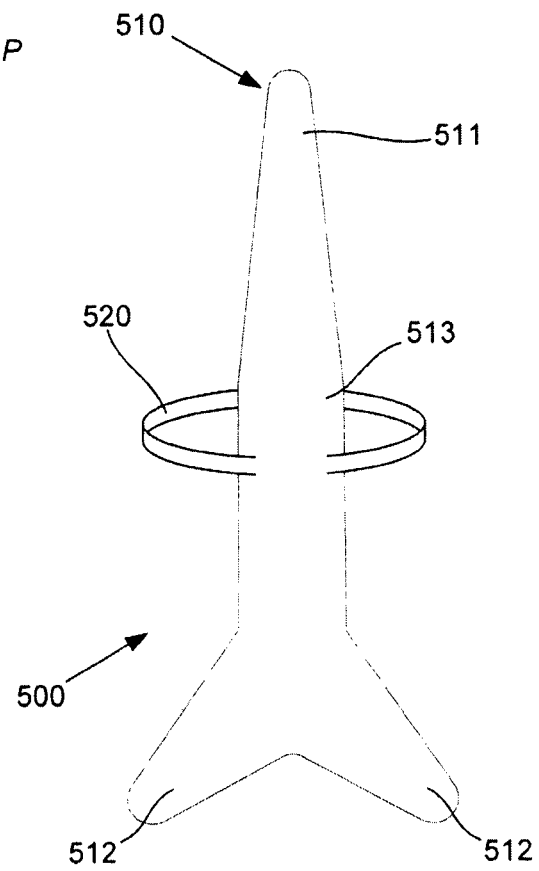
Figure 5C:
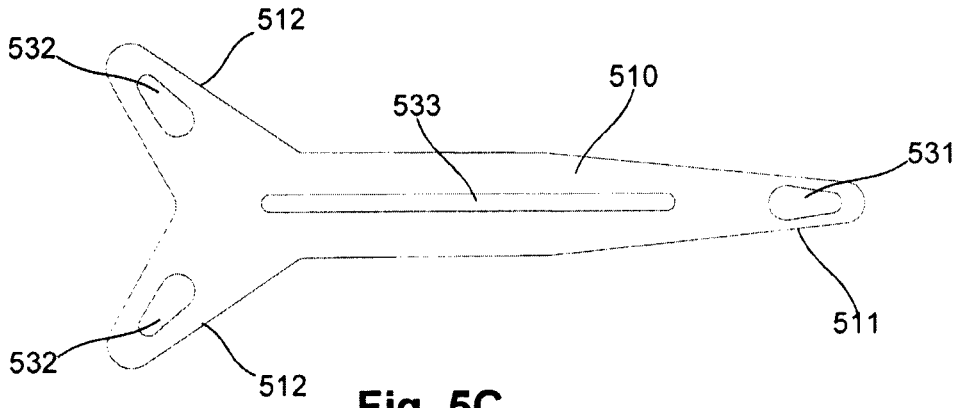

A third example of a swim training apparatus will now be described with reference to FIGS. 5A to 5C.

The apparatus 500 again includes a body 510 and strap 520. In this example, the body 510 includes a single first end 511 and two second ends 512, connected by a central portion 513. The two second ends 512 extend laterally away from the central portion 513 so the body has a Y-shape. In addition, the second ends 512 may project away from the body plane P, so that the second ends 512 project towards the user in use. The body 510 again includes contact surfaces 531, 532, provided at the ends 511, 512, and a ridge 533 extending along at least part of the length of the body 510, and positioned approximately midway across the width of the body 510.

When the apparatus is used in the first position, the contact surface 531 is provided near the user's sternum, whilst the surfaces 532 are positioned on the user's abdomen in the hypogastric region. In this example, having the second ends 512 extend laterally and optionally directed towards the user, the contact surfaces 532 are urged against left and right portions of the hypogastric region, and optionally against the user's pelvis, thereby further assisting in strengthening muscles during hip rotation, which in turn further contributes to maintaining core stability. A further benefit of the Y shape is that it can reduce contact between the body 510 and the user in the user's pelvic region, which can reduce undue loading on the user and hence prevent distress, for example during tumble turns.

A fourth example of a swim training apparatus will now be described with reference to FIGS. 6A to 6C.

The apparatus 600 again includes a body 610 and strap 620. In this example, the body 610 includes three body members 610.1, 610.2, 610.3 of similar shapes, but of similar or successively decreasing dimensions. In this example, three body members 610.1, 610.2, 610.3 are shown, but this is for the purpose of example only, and in practice any number of body members can be provided depending on use of the apparatus 600, as will be described in more detail below.

The body members 610.1, 610.2, 610.3 are provided in a layered arrangement, with the body members 610.1, 610.2, 610.3 being connected using any suitable connection mechanism, such as through the use of connectors 642, 643 provided on opposing surfaces of the body members 610.1, 610.2, 610.3. The connectors 642, 643 can act as guides to align the body members 610.1, 610.2, 610.3, and optionally to physically interconnect the body members 610.1, 610.2, 610.3. The connectors 642, 643 can be of any suitable form, and can include magnets, friction fit connectors, bolts, interference fit connectors, or the like.

By providing body members 610.1, 610.2, 610.3 in a layered arrangement can provide a number of benefits. For example, when the body members 610.1, 610.2, 610.3 flex, they cooperate in a manner similar to a leaf spring, so that the overall rigidity of the body 610 will depend on the number of and construction of the body members 610.1, 610.2, 610.3 provided. This therefore provides a mechanism for adjusting the body rigidity, for example by adding or removing body members, or by replacing body members with members having a greater or lower rigidity. Additionally, body members may have different sizes, allowing the apparatus to be used by different sized users.

In this example, the strap 620 is connected to the body member 610.3 positioned outwardly from the user. This can assist in maintaining the integrity of the body 610, by having the inward body members 610.1, 610.2 urged against the user by the outer body member 610.3.

Additionally, the body member 610.3 is typically sized to be suitable for use of users of any size. However, this arrangement is not essential and the strap 620 can be coupled to any one or more of the body members 610.1, 610.2, 610.3.

The body members may be manufactured from any suitable material, such as polyurethane, plastic sheets, or the like. In one particular example, different body members are manufactured from different materials to thereby provide for greater flexibility in rigidity, to allow greater comfort, or the like. Body members can also have different buoyancies, thereby allowing the overall buoyancy of the apparatus 600 to be controlled.

The body members can also have different shapes, so that for example, at least some of the body members can be Y-shaped, as will be described in more detail below.

Figure 7A:
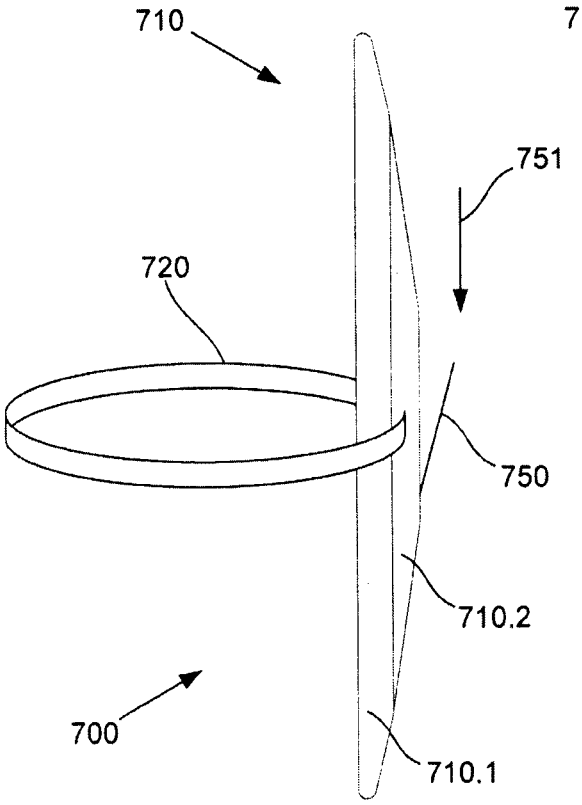
FIGS. 7A and 7B are schematic side and plan views of a fifth example of a swim training apparatus.
Figure 7B:
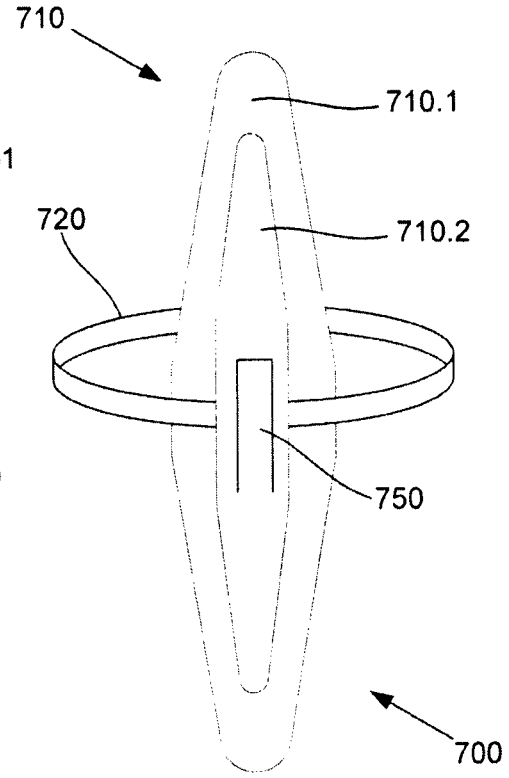
Figure 8A:
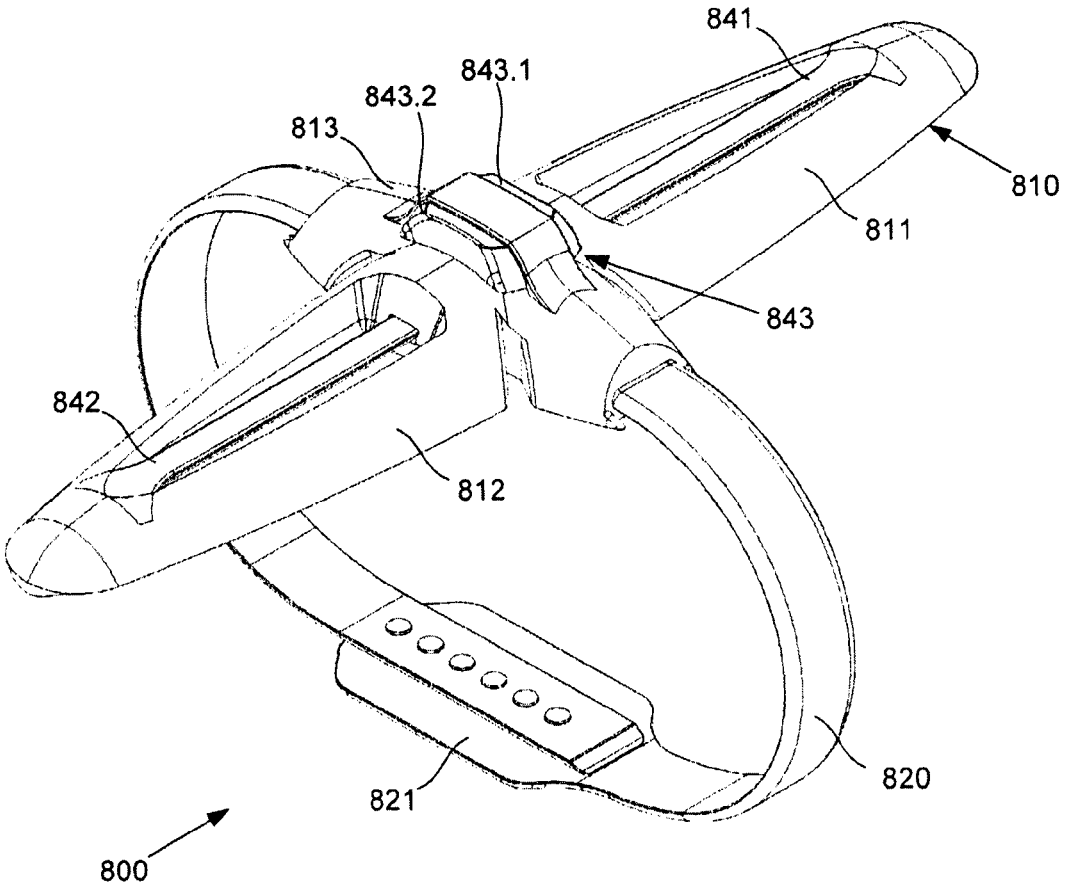
FIGS. 8A to 8E are schematic perspective, plan, end, underside and side views of a sixth example of a swim training apparatus.
Figure 8B:
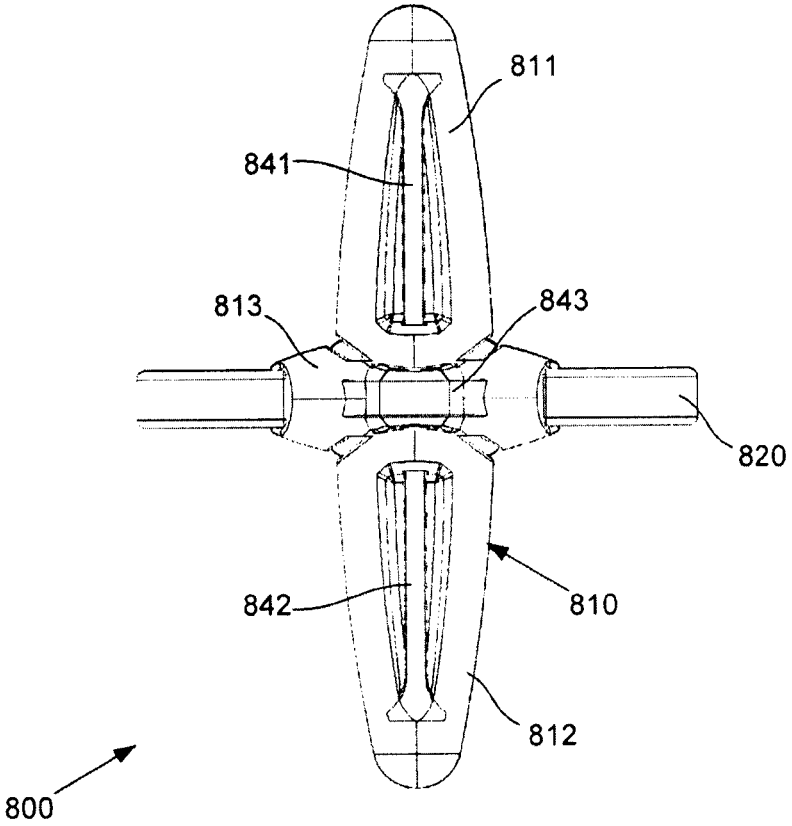
Figure 8C:
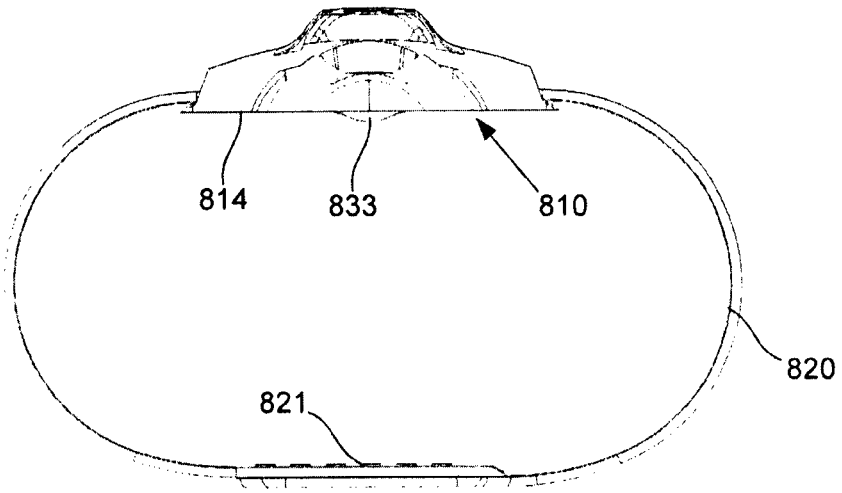
Figure 8D:
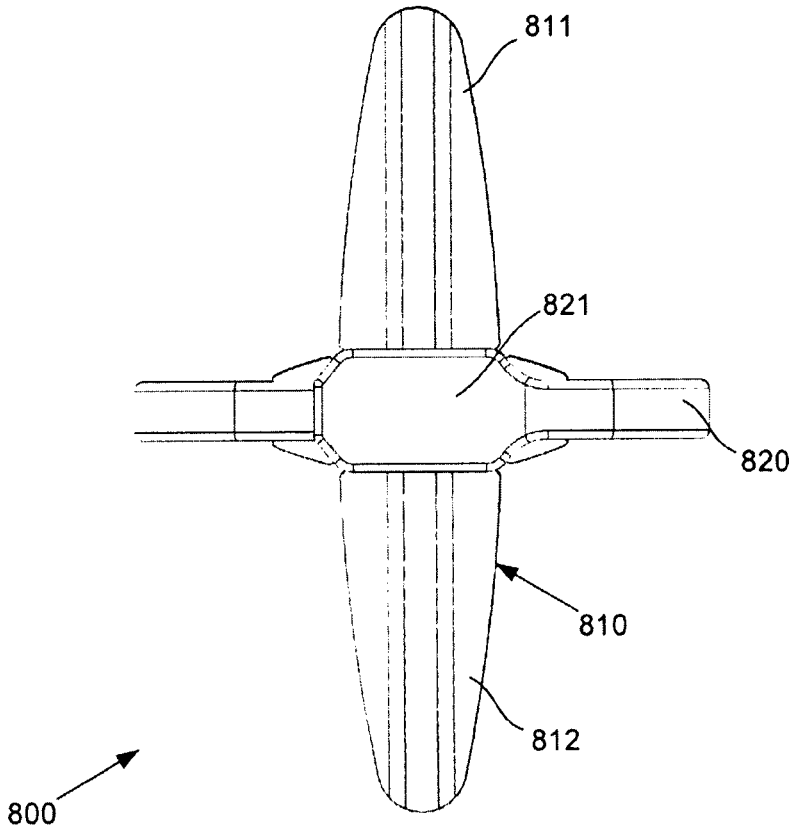
Figure 8E:
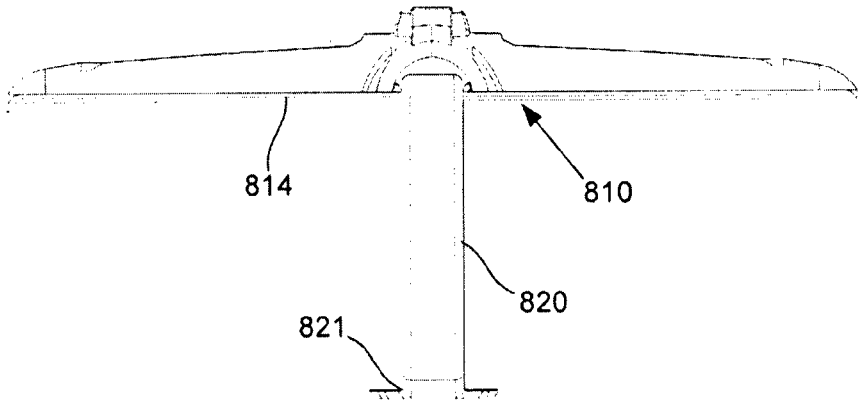
Figure 8F:
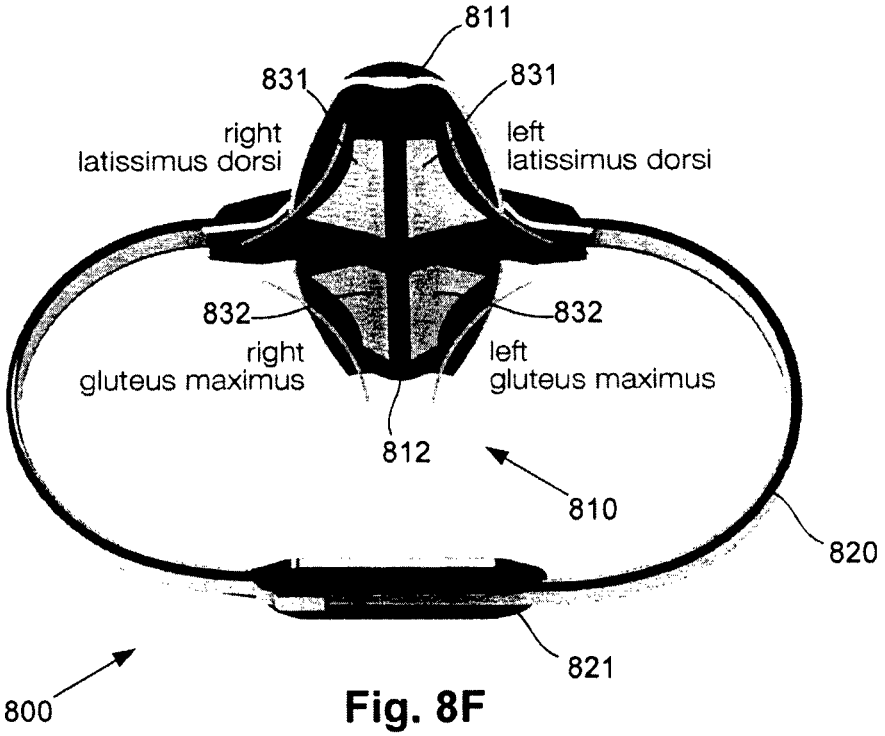
FIGS. 8F and 8G are schematic perspective views of the underside of the swim training apparatus of FIGS. 8A to 8E.
Figure 8G:
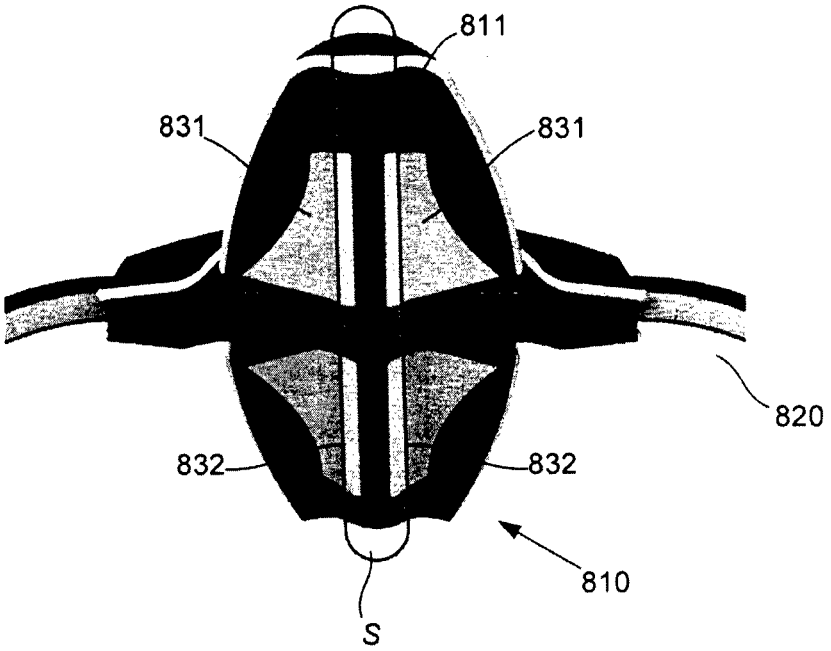

A fifth example of a swim training apparatus will now be described with reference to FIGS. 7A and 7B.

In this example, the apparatus 700 includes a body 710 having a body member 710.1 and supporting spine 710.2. In this example, the spine 710.2 is typically formed from a relatively stiff material, such as hard polyurethane to provide rigidity, whilst the body member 710.1 is formed from a softer material, such as soft polyurethane, to provide greater comfort to the user in use. It will be appreciated that in one example the spine can be embedded within a soft polyurethane outer body member, allowing the body to be created using a two shot moulding process.

In this example, the spine 710.2 also includes a flap 750 mounted thereon, so that as water flows over the apparatus in the direction of the arrow 751, water is directed under the flap 750, thereby increasing drag. This increases the workload required by a user to maintain a given speed, thereby helping with training.

A sixth example of a swim training apparatus will now be described with reference to FIGS. 8A to 8G.

In this example, the apparatus 800 includes a body 810 having body end members 811, 812, flexibly connected to a central body member 813. The body 810 also includes tensioning cords 841, 842 extending from the central body member 813 along the end body members 811, 812. The tensioning cords 841, 842 are connected to an actuator 843, having actuator buttons 843.1, 843.2. The actuator 843, which can use a gear and ratchet arrangement, or similar, allows tension within the tensioning cords 841, 842 and hence the overall rigidity of the body 811, 812, to be adjusted.

The buttons 843.1, 843.2 can be actuated using the thumb and forefinger to perform a squeezing action at waist level, in front or behind the body, making this method of adjustment highly suitable for this device. When the buttons are squeezed, these cords retract slightly, bending the product into a uniform curve, fitting the curvature of the back, and altering resistance for resistance training. Five levels of resistance are offered, meaning swimmers with naturally curved or straight backs alike can use the apparatus 800 comfortably, with the body 810 fitting to the user's body curvature as desired.

The body 810 is made of flexible polyurethane as this allows the body 810 to flex when resistance is applied, but also exhibits excellent shape memory, ensuring the product can be repeatedly adjusted without permanent deformation. Polyurethane is also suitably weather resistant, and can be treated to provide UV-blocking, thereby making the apparatus 800 to be used in a wide range of conditions, including outdoors. To provide the required rigidity to the device, the tension cords 841, 842 and the actuator 843 are made of hardened polyurethane, allowing these components to maintain tension while the main body of the product flexes. Use of polyurethane also allows the apparatus to be injected moulded, making the product cheap and easy to manufacture.

A strap 820 is connected to the central body member 813, and includes an adjustable press fit fastener 821, allowing the length of the strap 820 to be adjusted, as well as to allow the strap 820 to be unfastened to assist with fitting to the user. In one example, the fastener includes plugs and slots, with the slots inset into the strap, meaning the plug is not in contact with the wearer's skin, preventing pinching. Furthermore, the strap 820 can be made from a semi-soft silicone, providing a comfortable contact surface for the skin.

In one example, the fastener 821 is semi-rigid so that when the strap is fastened, forces against the user are focussed in the location of the fastener 821, thereby providing additional feedback to the user. For example, when used in resistance mode, the user can increase the force applied by the fastener 821, whilst the user seeks to minimise force applied by the fastener 821 during posture or guidance training.

In this example, the body 810 also includes a ridge 833 mounted to the body surface 814 to assist aligning the body 810 with the user's spine S, when the apparatus is used in the second position, or sternum when used in the first position. Similarly, a number of gel pads 831, 832 are provided on the surface 814 of the end body members 811, 812, with the gel pads being positioned by the user above and below the navel for in the first position, or between the latissimus dorsi and upper gluteus maximus for the second position.

Use of the apparatus 800 is therefore very simple and intuitive, requiring very few steps to adjust and operate. Users can easily centre the device to their stomach or back, before adjusting the strap 820 to a desired fit using its simple notch and plug design. Once the strap 820 is fastened, users can then adjust resistance as desired using the squeeze buttons at the middle of the device. In one example, the neutral setting for the apparatus 800 is maximum resistance, meaning each button squeeze will decrease resistance, with five levels available. The sixth squeeze will then return the apparatus 800 to maximum resistance. Once fully adjusted, the swimmer can work with the product to achieve and maintain proper posture and body position.

Figure 9A:
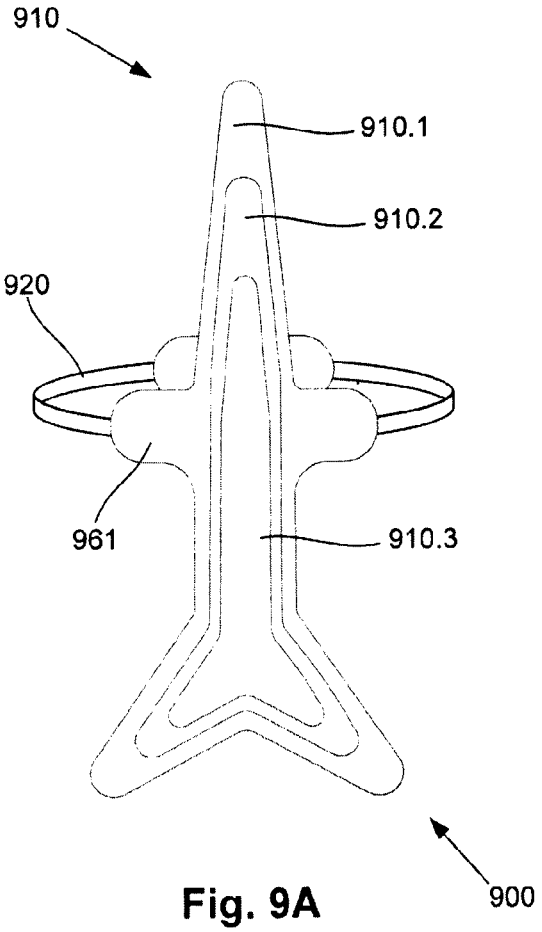
FIGS. 9A and 9B are schematic plan and underside views of a seventh example of a swim training apparatus.
Figure 9B:
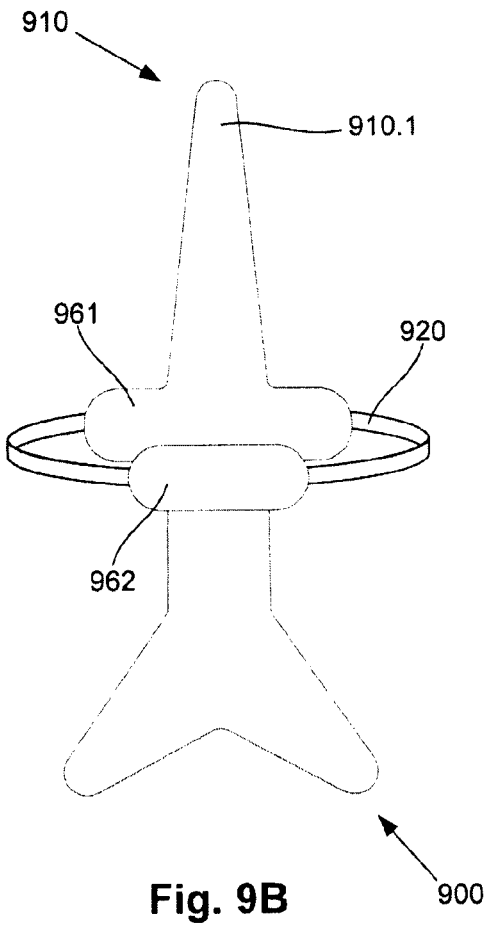
Figure 10A:
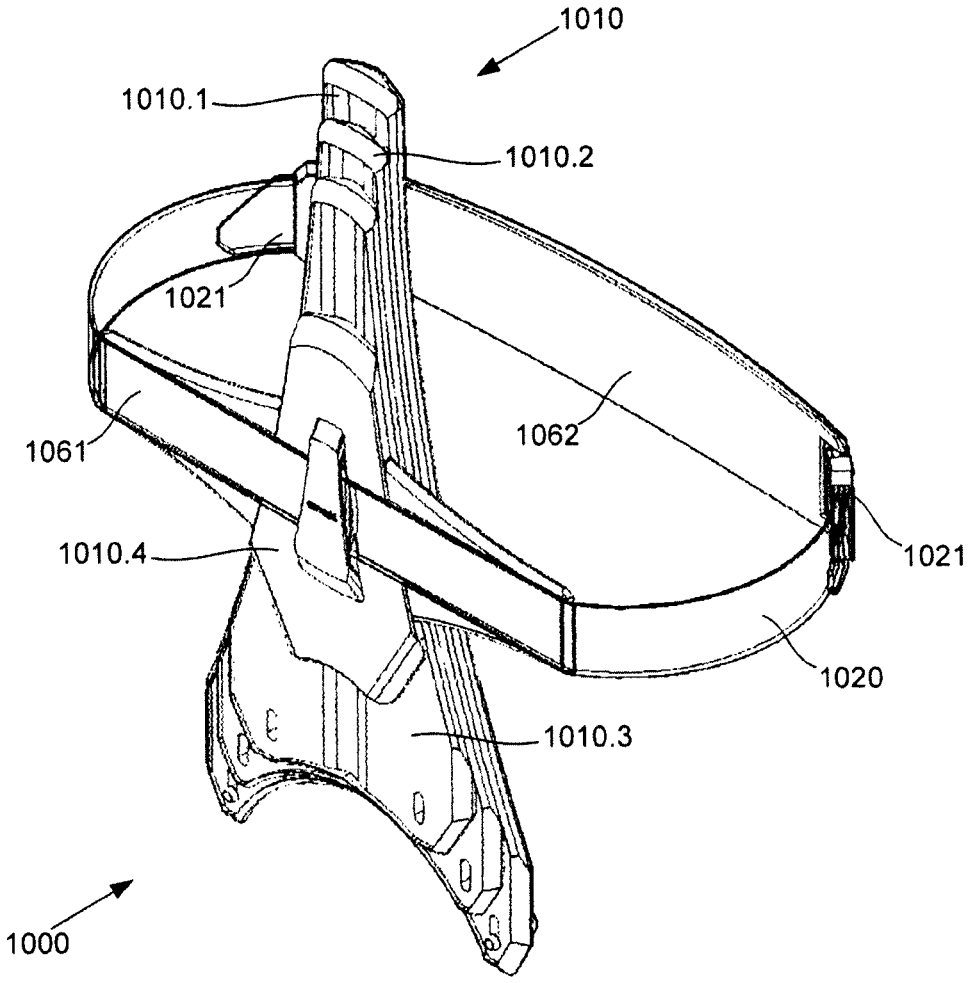
FIGS. 10A to 10E are schematic perspective, plan, end, underside and side views of an eighth example of a swim training apparatus; and, FIGS. 11A to 11J are schematic views of a ninth example of a swim training apparatus.
Figure 10B:
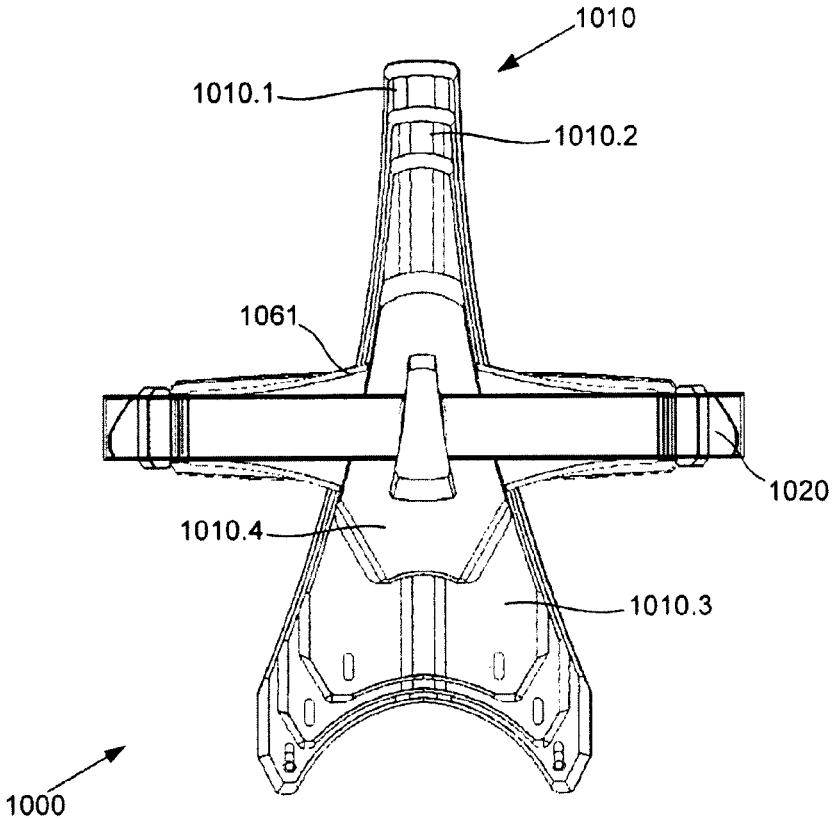
Figure 10C:
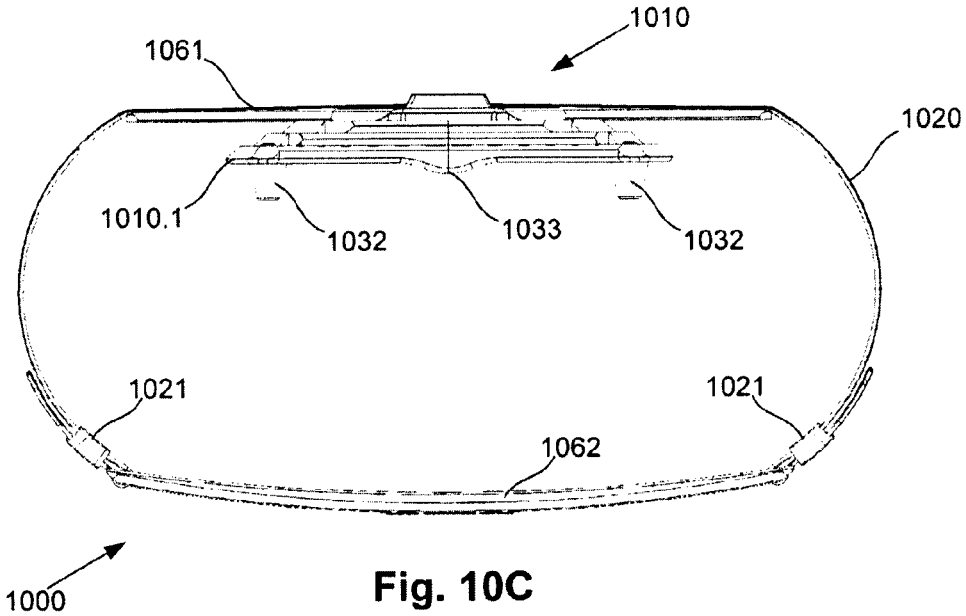
Figure 10D:
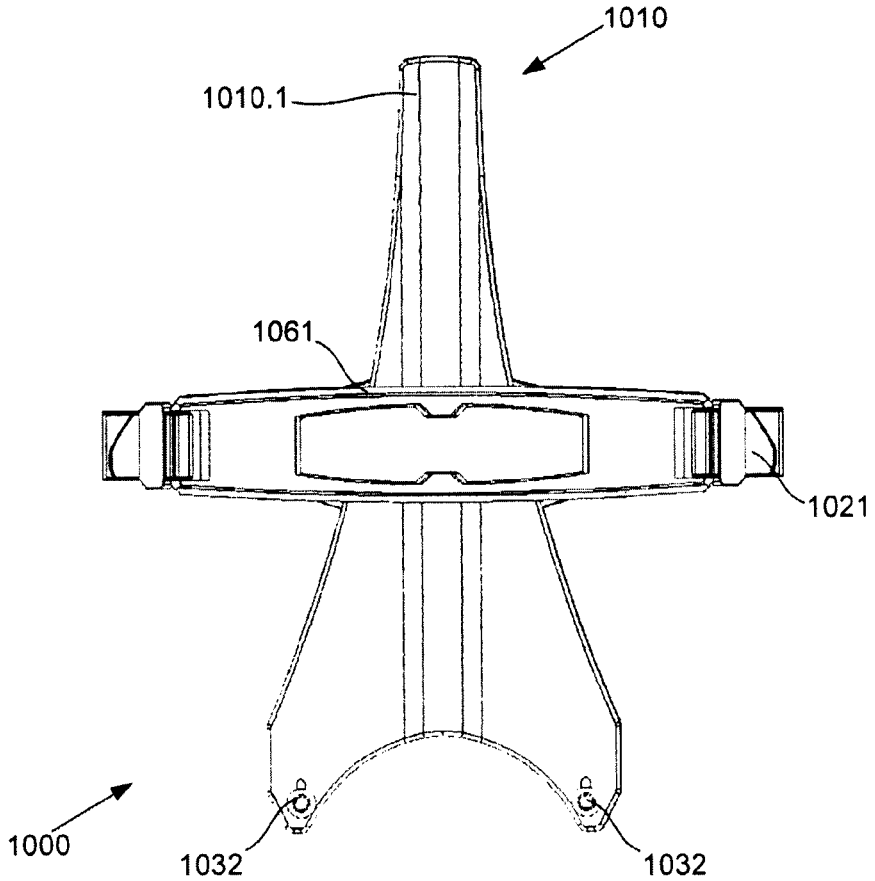
Figure 10E:
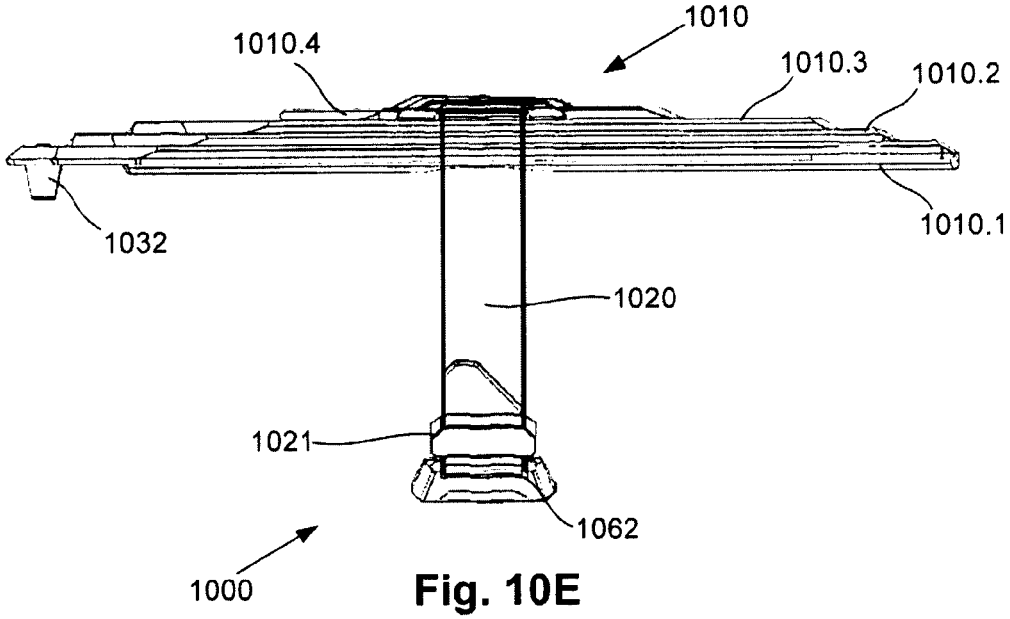
Figure 11A:
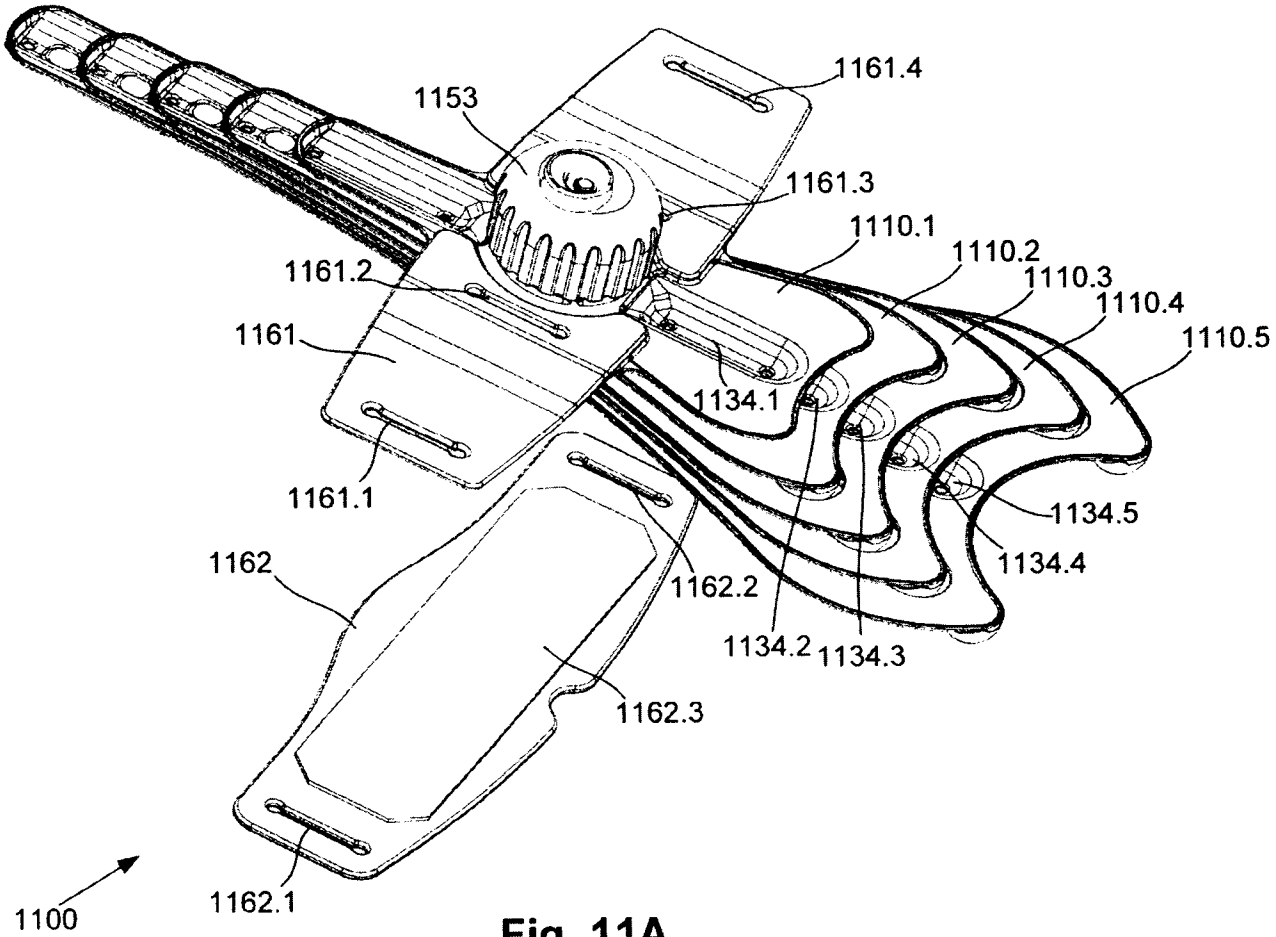
Figure 11B:
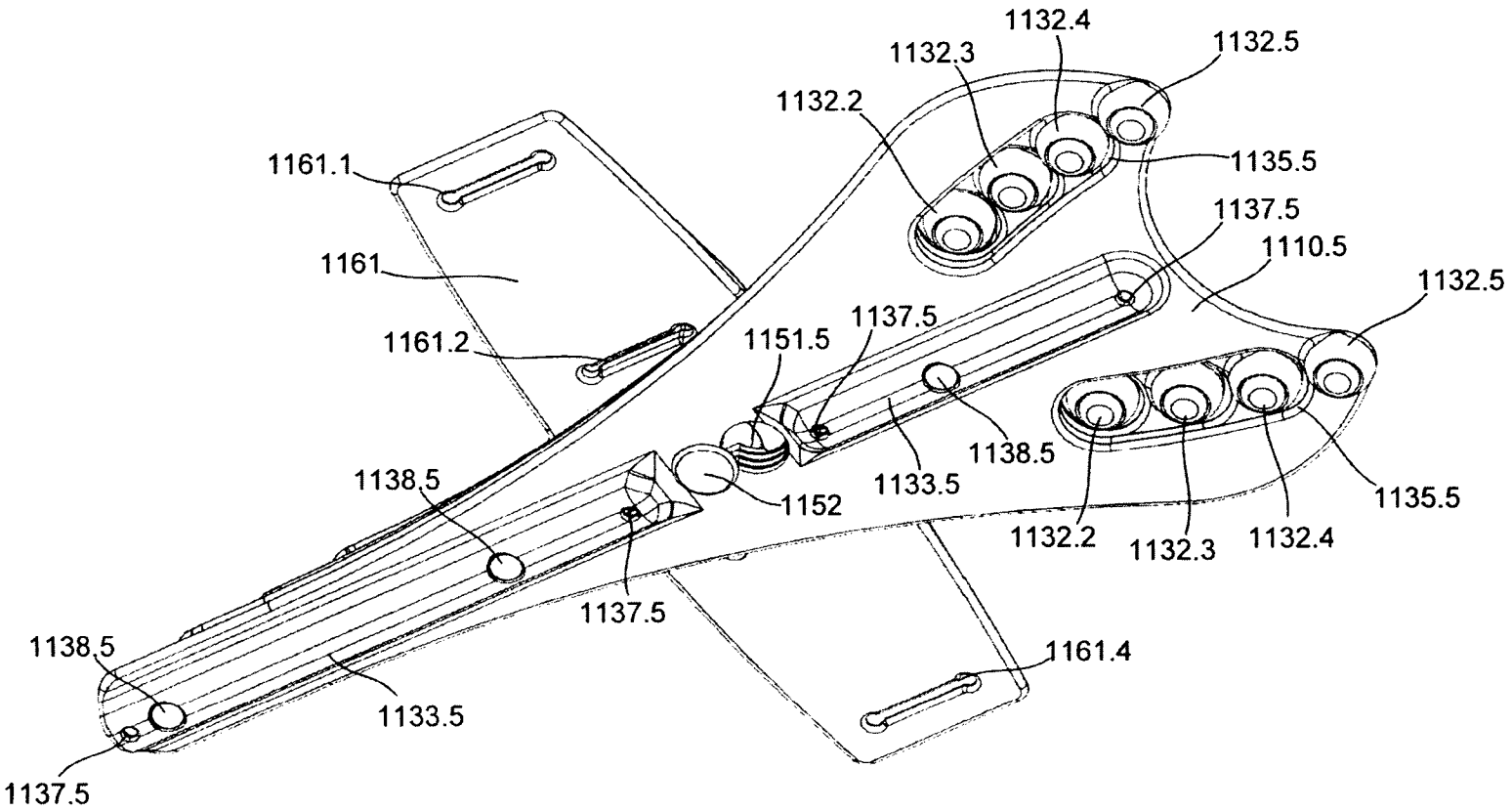
Figure 11C:
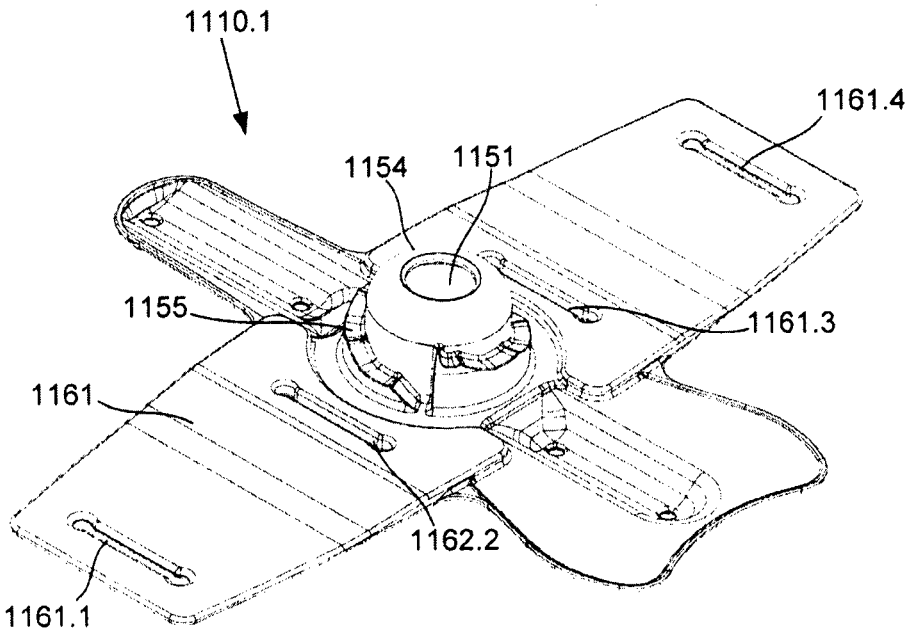
Figure 11D:
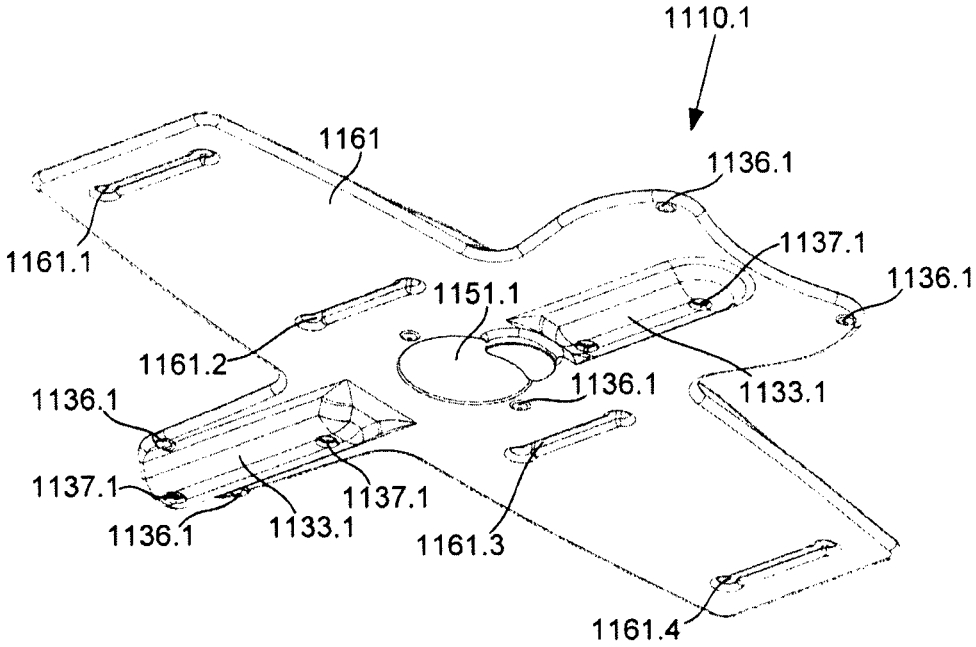
Figure 11E:
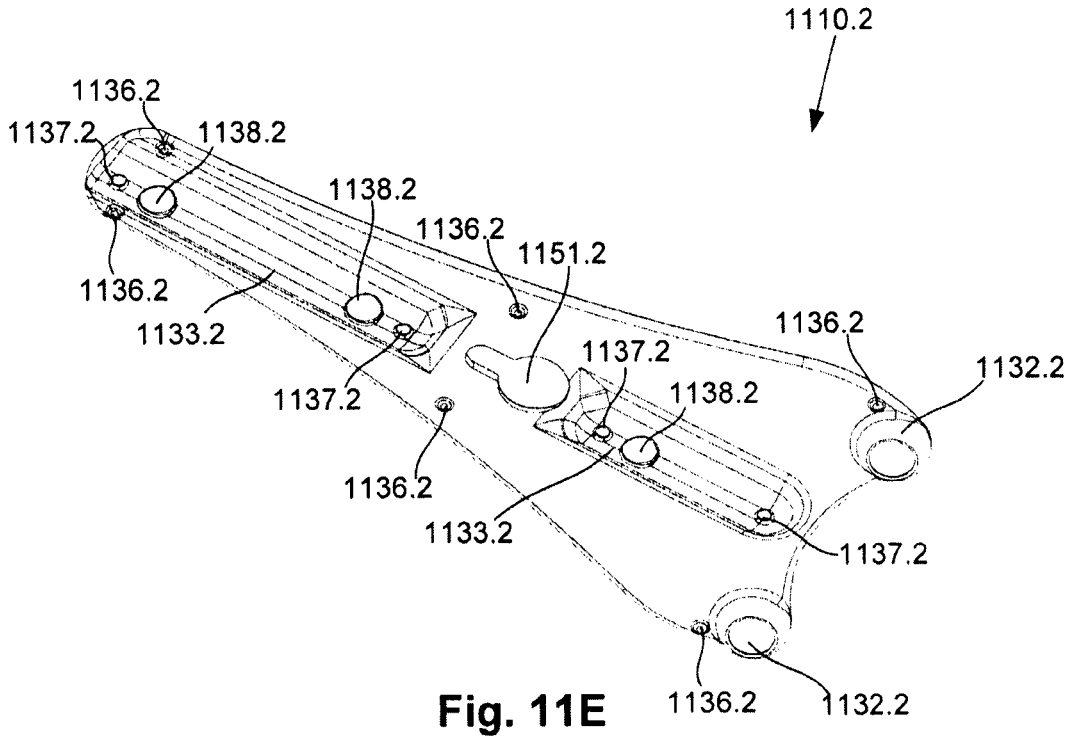
Figure 11F:
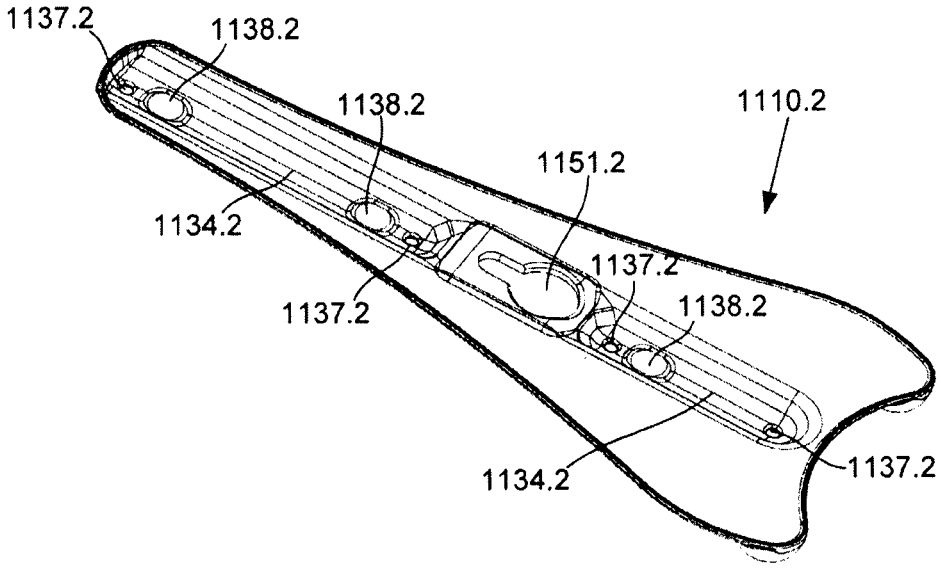
Figure 11G:
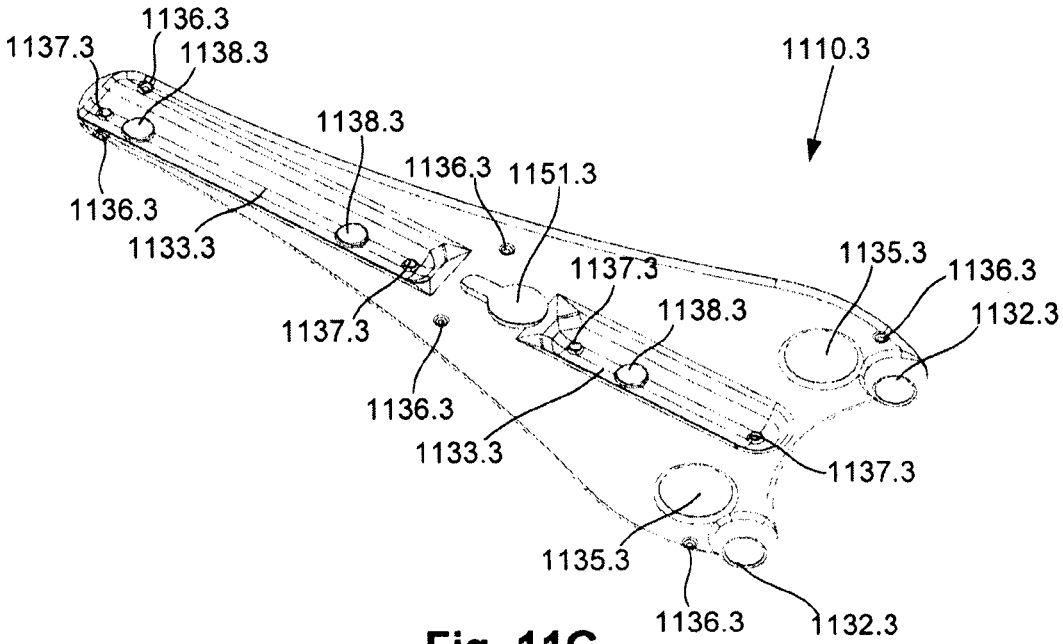
Figure 11H:
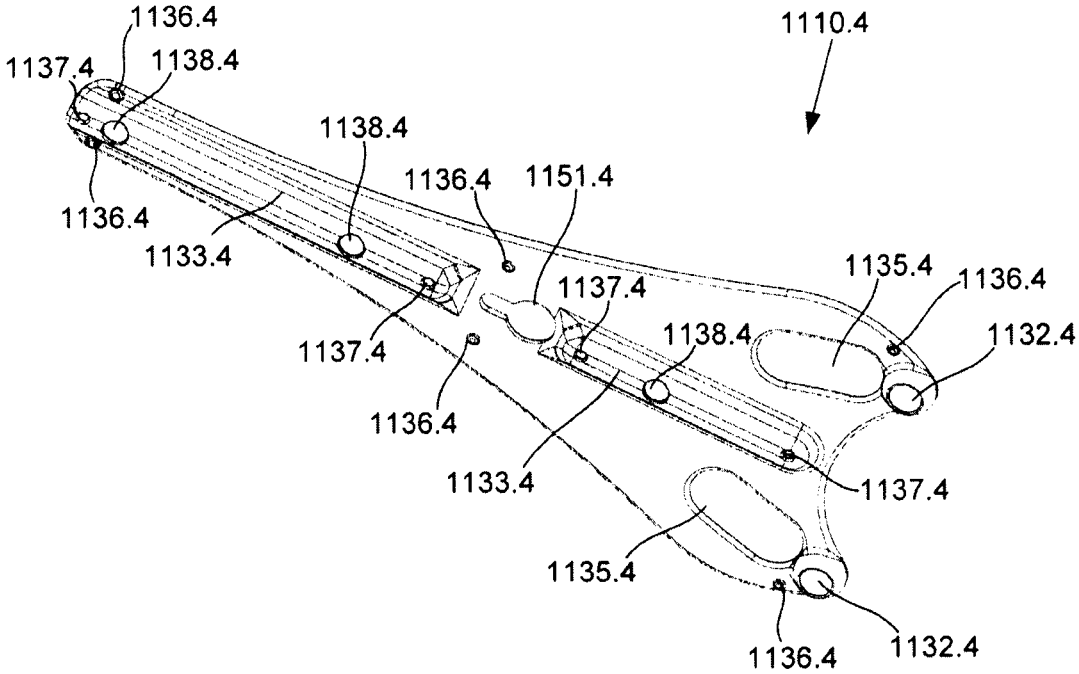
Figure 11I:
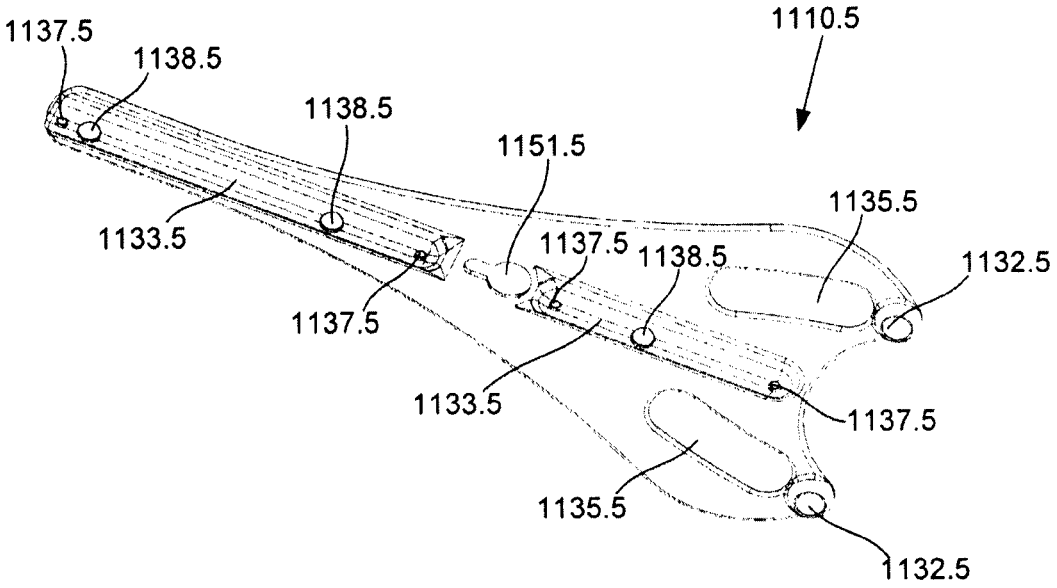
Figure 11J:
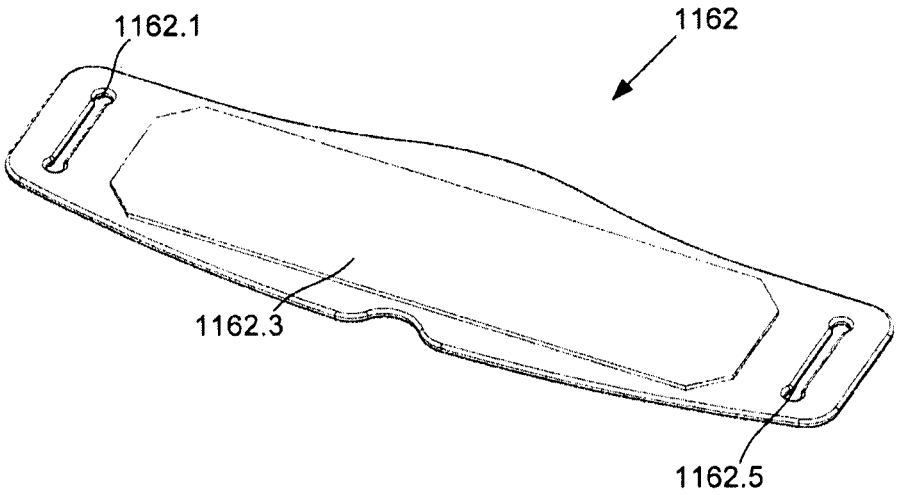

A seventh example of a swim training apparatus will now be described with reference to FIGS. 9A and 9B.

Figure 6A:
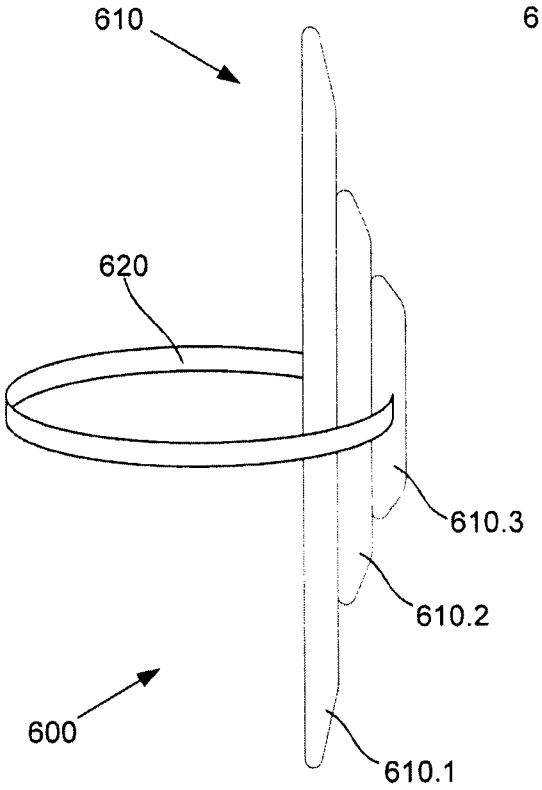
FIGS. 6A and 6B are schematic side and plan views of a fourth example of a swim training apparatus.
Figure 6B:
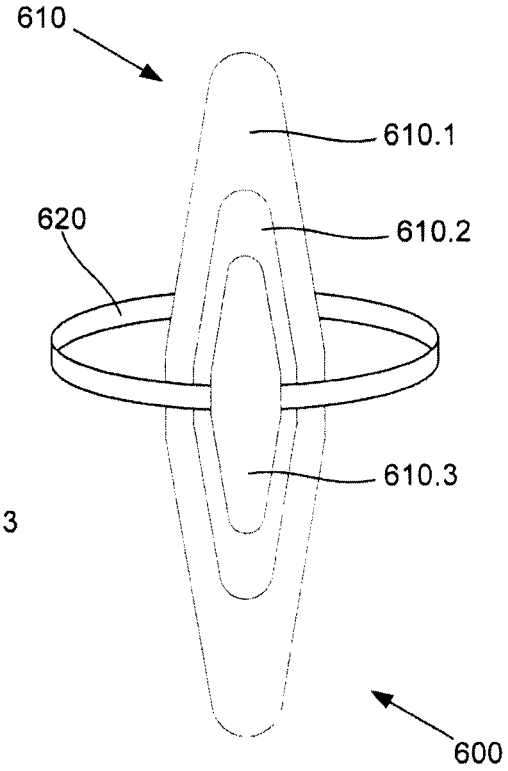
Figure 6C:
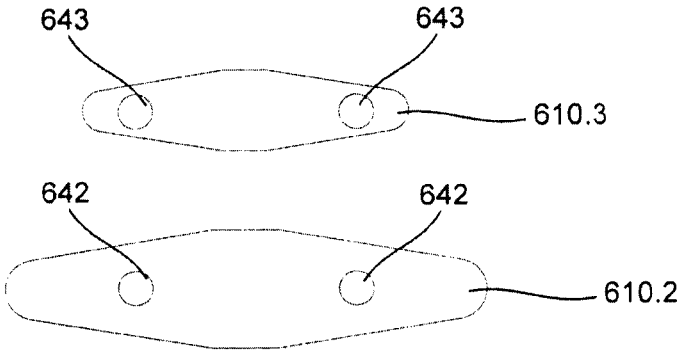
FIG. 6C is a schematic plan view of body members of swim training apparatus of FIGS. 6A and 6B.

In this example, the apparatus 900 includes a body 910 including three body members 910.1, 910.2, 910.3 of successively decreasing dimensions, provided in a layered arrangement using a suitable connection mechanism, in a manner similar to that described with respect to the fourth example of FIGS. 6A to 6C. The body members are substantially Y-shaped as per the third example of FIGS. 5A to 5C, and it will therefore be appreciated that this arrangement can provide benefits similar to those discussed above with respect to these examples.

In addition to this, the body 910 and strap 920 include respective waists 961, 962. The waists 961, 962 provide points of contact with the user's back and front, depending on whether the apparatus is used in the first or second positions. This provides a greater surface area of contact between the user and the apparatus 900 in the region of the strap 920, which can increase the comfort when the apparatus 900 is worn by the user, for example to stop the body 910 or strap 920 digging into the user's body. Additionally, the waists 961, 962 can increase the feedback provided to the user, thereby enhancing the effectiveness of the apparatus 900 in use.

An eighth example of a swim training apparatus will now be described with reference to FIGS. 10A to 10E. This example combines features from a number of different examples above. As the operation of these features have been previously described, these will not be described in further detail for this example, and their operation will be understood from the examples above.

In this example, the apparatus 1000 includes a body 1010 having four body members 1010.1, 1010.2, 1010.3, 1010.4, with a strap 1020 being attached to the body member 1010.4, which also supports a waist 1061. The body members 1010.1, 1010.2, 1010.3 are substantially Y-shaped and can be selectively interconnected, allowing properties of the body 1010, such as the rigidity, size, shape and profile, to be adjusted.

The strap 1020 includes a waist 1062. Adjustable fasteners 1021 are provided on either side of the waist 1062, allowing the size of the strap to be adjusted for a particular user, whilst allowing the waist 1062 to maintain a central position with respect to the strap 1020. This ensures that the strap 1020 is correctly positioned on the user in use.

Contact surfaces 1032, 1033 are provided on at least the body member 1010.1 that is to contact the user. The contact surfaces 1032 are positioned on arms of the Y-shaped body member 1010.1, allowing the contact surfaces to engage the hypogastric region of the user, thereby providing feedback points to the user in use, whilst the contact surface 1033 is in the form of a ridge extending along the body member 1010.1, allowing the body 1010 to be aligned with the user's spine or sternum. It will be appreciated that similar contact surfaces can be provided on each body member 1010.1, 1010.2, 1010.3, thereby assisting to align the body members with respect to each other.

A ninth example of a swim training apparatus will now be described with reference to FIGS. 11A to 11J. This example includes features similar to those from previous examples, and these will not therefore be described in detail for this example. Similarly operation of the apparatus will generally be understood from the above examples and will not be described in detail.

In this example, the apparatus 1100 includes a body having five body members 1110.1, 1110.2, 1110.3, 1110.4, 1110.5. For the purpose of clarity features of each of the body members will be identified with the suffixes .1, .2, .3, .4, .5, as appropriate. The body members 1110.1, 1110.2, 1110.3, 1110.4, 1110.5 are adapted to be coupled together in a layered arrangement in a manner similar to that described with respect to the example of FIGS. 10A to 10E.

In this regard, each body member 1110.1, 1110.2, 1110.3, 1110.4, 1110.5 includes an aperture 1151.1, 1151.2, 1151.3, 1151.4, 1151.5, with the apertures 1151.2, 1151.3, 1151.4, 1151.5 having a key shape to allow to a lug 1152 to be inserted therethrough. The lug 1152 is typically coupled to a first body member 1110.1, so that it can be inserted through and then provided in engagement with one of the apertures 1151.2, 1151.3, 1151.4, 1151.5 thereby coupling two or more of the body members 1110.1, 1110.2, 1110.3, 1110.4, 1110.5 together.

In one example, the lug 1152 is coupled to the first body member 1110.1 via a shaft (not shown), which is attached to a knob 1153, which in turn sits on a mounting 1154. The knob 1153 and mounting 1154 are generally cylindrical allowing the knob 1153 to be rotated relative to the mounting 1154. The mounting 1154 includes a cam ridge 1155 extending therearound, with the knob 1153 including a cam follower (not shown) mounted on an inner surface thereof. In use, as the knob 1153 is rotated, the follower engages the cam ridge 1155 to allow the knob 1153 to be moved progressively away from the first body member 1110.1. A spring may also be provided to urge the knob 1153 towards the first body member 1110.1, so that the cam is positively engaged.

In use, the lug 1152 is inserted through and into engagement with the aperture 1151.2, 1151.3, 1151.4, 1151.5 of a respective one of the body members 1110.2, 1110.3, 1110.4, 1110.5. The knob 1153 is then rotated, with the follower engaging the cam 1155, thereby urging the lug 1152 against an underside of the body 1110.2, 1110.3, 1110.4, 1110.5 at the edge of the respective aperture 1151.2, 1151.3, 1151.4, 1151.5, thereby clamping the body members together as required.

As in previous examples, each body member 1110.1, 1110.2, 1110.3, 1110.4, 1110.5 has a generally similar Y-shaped configuration. In this example, each body includes a respective ridge 1133.1, 1133.2, 1133.3, 1133.4, 1133.5, extending along at least part of a length of the respective body member 1110.1, 1110.2, 1110.3, 1110.4, 1110.5. The ridge 1133.1, 1133.2, 1133.3, 1133.4, 1133.5 acts to guide placement of the apparatus 1110 on the user, as described with respect to previous examples. The ridges 1133.2, 1133.3, 1133.4, 1133.5 may also include pads 1138.2, 1138.3, 1138.4, 1138.5, positioned along the ridge. The pads can be made of a material having a relatively high coefficient of friction, such as rubber or the like, so that the pads 1138.2, 1138.3, 1138.4, 1138.5 can assist in preventing unwanted movement of the apparatus 1100 relative to the user. The pads can also assist in making the apparatus more comfortable to wear.

Additionally, in this example, the ridge 1133.1, 1133.2, 1133.3, 1133.4, 1133.5 of each body member 1110.1, 1110.2, 1110.3, 1110.4, 1110.5 forms a complementary ridge recess 1134.1, 1134.2, 1134.3, 1134.4, 1134.5 provided on a reverse side of the body member. The ridge recess 1134.1, 1134.2, 1134.3, 1134.4, 1134.5 is designed to receive the ridge 1133.1, 1133.2, 1133.3, 1133.4, 1133.5 of an adjacent body member, thereby acting as a guide to ensure correct relative alignment of the body members 1110.1, 1110.2, 1110.3, 1110.4, 1110.5.

Each body member 1110.2, 1110.3, 1110.4, 1110.5 also includes contact surfaces 1132.2, 1132.3, 1132.4, 1132.5 in the form of protrusions, which may include a rubber or other suitable material tip provided thereon. The contact surfaces 1132.2, 1132.3, 1132.4, 1132.5 are typically positioned on arms of the Y-Shaped body members so that in use, the contact surfaces 1132.2, 1132.3, 1132.4, 1132.5 engage the hypogastric region of the user, thereby providing feedback points to the user in a manner similar to that previously described.

The body members 1110.3, 1110.4, 1110.5 typically further include respective guide apertures 1135.3, 1135.4, 1135.5 to receive the contact surfaces 1132.2, 1132.3, 1132.4, of other body members 1110.2, 1110.3 , 1110.4. Insertion of the contact surfaces 1132.2, 1132.3, 1132.4, into the guide apertures acts to align the body members, thereby providing a further guide mechanism.

Each body member 1110.1, 1110.2, 1110.3, 1110.4, also includes body member contact points 1136.1, 1136.2, 1136.3, 1136.4, for abutting against an adjacent body member 1110.2, 1110.3, 1110.4, 1110.5, thereby maintaining the relative position of the body members 1110.1, 1110.2, 1110.3, 1110.4, 1110.5. This also helps maintain a separation between the body members 1110.1, 1110.2, 1110.3, 1110.4, 1110.5, allowing water to drain from the apparatus, and in particular from between the body members, when the device is not in use. Additional drainage apertures 1137.1, 1137.2, 1137.3, 1137.4, 1137.5 can also be provided to further assist with drainage, and in particular to allow water to drain from the ridge recesses 1134.1, 1134.2, 1134.3, 1134.4, 1134.5.

The first body member 1110.1 typically includes a waist 1161 extending laterally outwardly from the body member 1110.1. The waist 1161 includes apertures 1161.1, 1161.2, 1161.3, 1161.4 for receiving a strap (not shown), thereby allowing the apparatus 1100 to be attached to the user. The strap can also include a waist 1162 including apertures 1162.1, 1162.2 allowing the position of the waist 1162 relative to the strap to be adjusted. In this example, an inner surface of the waist 1162 may also include a pad 1162.3, formed of rubber or other similar material, to provide for further comfort.

In use, the waist 1162 can provide a number of benefits. Firstly, this allows the apparatus 1100 to be urged against the body, whilst maintaining comfort by distributing the pressure created by the strap over a wider area. Secondly, the waist can be made of a resilient material, so that only limited bending of the waist occurs. Consequently, this will tend to support the strap away from the user's body in between the waists 1161, 1162, thereby minimising the pressure applied to the sides of the user, in use. This helps prevent core support being provided solely by the presence of the strap, which could reduce the effectiveness of the apparatus at inducing increased core strength and stability.

In use, a buckle or other coupling mechanism for the strap can be arranged against an outer surface of the waist 1162, so that the waist 1162 prevents the buckle digging into the wearer, thereby making the apparatus 1100 more comfortable to wear. However, alternatively the strap can include one or two buckles or other adjustment mechanisms provided on the strap between the waists 1161, 1162, on one or both sides of the user. This makes the strap easier to adjust, and in particular avoids the user having to reach behind their back to actuate a buckle, as may be the case if the buckle is provided in the vicinity of the body member 1110.1 or the adjacent the waist 1162. It will be appreciated that the use of two buckles or adjustment mechanisms can be particularly advantageous as this allows straps to be tightened on either side of the user's body symmetrically, which can prevent undue rotation of the strap about the user, which can misalign the apparatus 1100.

Accordingly, it will be appreciated that in use a number of body members 1110.1, 1110.2, 1110.3, 1110.4, 1110.5 can be stacked together and then interconnected using the lug 1152 and cam arrangement. This allows a number of body members to be selectively coupled to the body member 1110.1, thereby allowing the number of body members 1110.1, 1110.2, 1110.3, 1110.4, 1110.5 and hence the stiffness and size of the apparatus 1100 to be adjusted. In one example, a first body member 1110.1, acts as a base member, with one or more other body members 1110.2, 1110.3, 1110.4, 1110.5 being attached thereto so that the overall apparatus 1100 has desired properties.

The arrangement also allows body members 1110.1, 1110.2, 1110.3, 1110.4, 1110.5 having different sizes and properties to be used interchangeably, allowing the apparatus to be used for a wide variety of purposes. For example the size of the first body 1110.1 can be adjusted to suit different sized individuals, such as children or adults. Different properties of other bodies, such as the buoyancy can also be adjusted, allowing the apparatus to be used by children when learning to swim, with the overall buoyancy being progressively decreased as the user's swimming ability improves.

It will be appreciated that features of the above described examples can be used in combination or isolation, and can be interchanged, allowing a range of different arrangements to be provided.

It will also be appreciated that the rigidity of the body can be adjusted in other manners. For example, a spring and hinge system can be used to connect rigid end body members, so that the body members can pivot relative to each other or a central body member, about the hinge. In this example, adjusting tension in the spring can alter the rigidity of the hinge and hence the body. However, such mechanisms are typically complex to manufacture and include components not suited for repeated submersion in water. Additionally, the hinge mechanism would also be susceptible to breakage over time, given that swimmers would often be exerting significant forces through the device, which would ultimately be channelled to the central hinge.

A further alternative is the use of Electroactive Polymer (EAP) technology incorporated into the body, to allow the body to be deformed upon application of a suitable voltage. However, EAPs require a constant presence of electricity to maintain their deformed shape, which would mean the device would require an electrical supply, which would not be preferable given the product's constant contact with water.

Accordingly, whilst the techniques used in the above examples are preferred, it will be appreciated that a range of different rigidity adjustment mechanisms can be used.

Whilst the above described examples have focussed on the use of a single apparatus in first and second positions to provide both resistance and posture training, this is not essential, and alternatively different versions of the apparatus may be provided for use in the first and second positions or to provide resistance and posture training respectively. A further variation is that the apparatus can include two bodies mounted to a common attachment mechanism, so that one of the bodies is worn in the first position whilst the second is worn in the second position, thereby allowing posture and resistance training to be performed simultaneously.

Furthermore, whilst the above described examples have focussed on the use of at least semi-rigid bodies, rigid bodies could alternatively be used. In this example, the bodies may be specifically profiled to provide posture and/or resistance training, and/or to allow the apparatus to be used in the first and second positions, and/or to be used for different swimming strokes, respectively. In this regard, profiling can refer to the shape of the surface used to contact the user, as well as to the overall shape of the body.

Whilst the above description has focussed on use of the swim training apparatus during swimming, the apparatus can also be used in other swim training activities, including both in and out of pool activities. This can include, for example, warming up immediately before a competitive swimming event, or warming down after the event. Accordingly, it will be appreciated that the term swim training is intended to cover any activity associated with training a user for swimming, and should not be construed as limited to actual swimming per se.

In the above described examples, the swim training apparatus is attached to the user's body so as to contact the torso. In this regard, it will be appreciated that the term "torso" should be understood to encompass any part of the human body excluding the head and limbs. More particularly, the apparatus is typically attached by a strap around the user's waist region, with the body being in contact with either the user's back, or the user's front, and in particular at least part of the abdomen and part of the thorax.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. A swim training apparatus for training a user during swimming, the apparatus including:

a) an at least semi-rigid body, wherein the body is an elongate body extending in an elongation direction, the body including an elongate body spine extending in the elongation direction along a length of the body, the body spine providing rigidity to the body for resisting bending of the body along the length of the body; and b) an attachment mechanism to allow the body to be worn by the user so that at least part of the body contacts the user's torso and the elongation direction aligns with the user's spine, to thereby provide posture training for guiding user swimming posture.

2. The apparatus according to claim 1, wherein the body is tapered towards ends of the body.

3. The apparatus according to claim 1, wherein the body is Y-shaped.

4. The apparatus according to claim 1, wherein the body extends in a direction substantially parallel to a body plane defined by the body.

5. The apparatus according to claim 4, wherein the body includes at least one portion that extends at an angle relative to the body plane.

6. The apparatus according to claim 1, wherein rigidity of the body resists at least one of:

a) bending of the body; and, b) torsional movement of the body.

7. The apparatus according to claim 6, wherein the body extends along a body plane, and wherein rigidity of the body resists bending of the body at least in a direction orthogonal to the body plane.

8. The apparatus according to claim 1, wherein the body includes at least two body members having different rigidities.

9. The apparatus according to claim 1, wherein the rigidity of the body varies along the length of the body.

10. The apparatus according to claim 1, wherein the rigidity of the body depends on at least one of:

a) a body length;

b) a body thickness;

c) a body width; and, d) a body material.

11. The apparatus according to claim 1, wherein body ends have a reduced rigidity compared to a body centre portion.

12. The apparatus according to claim 1, wherein the body includes a rigidity adjusting mechanism for selectively adjusting body rigidity.

13. The apparatus according to claim 1, wherein the body includes a plurality of selectively connectable body members.

14. The apparatus according to claim 13, wherein the body members are provided in a layered arrangement.

15. The apparatus according to claim 13, wherein the number of connected body members is selected to thereby adjust at least one of:

a) body rigidity; and, b) body size.

16. The apparatus according to claim 13, wherein at least one of the body members includes at least one guide for at least one of aligning and connecting the body members.

17. The apparatus according to claim 16, wherein the guide includes at least one guide aperture provided on at least one body member, the guide aperture being for receiving contact points of at least one adjacent body member.

18. The apparatus according to claim 16, wherein the guide includes a ridge recess provided on at least one body member, the ridge recess being for receiving a ridge of at least one adjacent body member.

19. The apparatus according to claim 13, wherein the body members include an aperture, and wherein the apparatus includes a lug coupled to a first body member, the lug being for engaging the aperture of an other body member to thereby secure at least the other body member to the first body member.

20. The apparatus according to claim 19, wherein the lug is coupled to a knob provided on a mounting of the first body member, the mounting including a cam and the knob including a cam follower, and wherein in use, the follower engages the cam thereby so that the knob urges the lug against the aperture of the least one other body member to thereby secure the at least one other body member to the first body member.

21. The apparatus according to claim 1, wherein the body includes:

a) first and second relatively moveable body members; and, b) a resilient member to resist relative movement of the first and second body members.

22. The apparatus according to claim 21, wherein the first and second body members are connected using a hinge.

23. The apparatus according to claim 21, wherein the resilient member includes a tensioning cord.

24. The apparatus according to claim 1, wherein the body includes one or more contact surfaces for contacting the user.

25. The apparatus according to claim 24, wherein the contact surfaces include gel pads.

26. The apparatus according to claim 1, wherein the attachment mechanism includes a strap coupled to the body between ends of the body.

27. The apparatus according to claim 26, wherein the strap is attached to a first one of a plurality of body members.

28. The apparatus according to claim 27, wherein at least one of the strap and one of the plurality of body members include a waist.

29. The apparatus according to claim 28, wherein the strap is coupled to the body member substantially mid-way along the body member.

30. The apparatus according to claim 26, wherein the strap is configured to be worn around the user's waist in use.

31. The apparatus according to claim 1, wherein the body is configured to be worn in at least one of:

a) a first position in which the body is configured to contact at least part of the user's abdomen and part of the user's thorax; and, b) a second position in which the body is configured to contact at least part of the user's back.

32. The apparatus according to claim 31, wherein the body is configured to be worn in the first and second positions.

33. The apparatus according to claim 32, wherein the apparatus includes:

a) a first body configured to be worn in a first position in which the first body is configured to contact at least part of the user's abdomen and part of the user's thorax; and, b) a second body configured to be worn in a second position in which the second body is configured to contact at least part of the user's back.

34. The apparatus according to claim 1, wherein in a first position the body is configured to contact the user at least:

a) near the user's sternum; and, b) in a hypogastric region of the user's torso.

35. The apparatus according to claim 34, wherein in the first position the body is configured to contact at least left and right portions of the hypogastric region of the user's torso to thereby provide resistance to hip rotation of the user.

36. The apparatus according to claim 1, wherein in a second position the body is configured to contact at least part of the user's spine.

37. The apparatus according to claim 1, wherein the body includes a ridge extending along at least part of the body, wherein the ridge is for aligning the body with at least one of the user's spine and the user's sternum.

38. The apparatus according to claim 1, wherein at least one of a body profile, dimension, shape and rigidity is determined for at least one of:

a) providing posture training;

b) providing resistance training;

c) use in a first position;

d) use in a second position; and, e) use for respective swimming strokes.

39. A method of using the swim training apparatus according to claim 1, the method including a user wearing the swim training apparatus during swimming, wherein the swim training apparatus is worn by the user so that at least part of the body contacts the user's torso and the elongation direction aligns with the user's spine to thereby provide posture training for guiding user posture.

40. The method according to claim 39, wherein the swim training apparatus is worn by the user so that the body is in at least one of:

a) a first position in which the body contacts at least part of the user's abdomen and part of the user's thorax; and, b) a second position in which the body contacts at least part of the user's back.

41. The method according to claim 39, wherein the swim training apparatus is worn by the user so that, in a first position, the body contacts the user at least:

a) near the user's sternum; and, b) in a hypogastric region of the user's torso.

42. The method according to claim 41, wherein in the first position the body contacts at least left and right portions of the hypogastric region of the user's torso to thereby provide resistance to hip rotation of the user.

43. The method according to claim 41, wherein in a second position the body contacts at least part of the user's spine.

* * * * *